US009322243B2

(12) United States Patent
Baca et al.

(10) Patent No.: US 9,322,243 B2
(45) Date of Patent: Apr. 26, 2016

(54) AUTOMATED RELIEF VALVE CONTROL SYSTEM AND METHOD

(71) Applicant: S.P.M. Flow Control, Inc., Fort Worth, TX (US)

(72) Inventors: Matthew S. Baca, Fort Worth, TX (US); Brian C. Witkowski, Weatherford, TX (US)

(73) Assignee: S.P.M. Flow Control, Inc., Fort Worth, TX (US)

( * ) Notice: Subject to any disclaimer, the term of this patent is extended or adjusted under 35 U.S.C. 154(b) by 239 days.

(21) Appl. No.: 13/886,771

(22) Filed: May 3, 2013

(65) Prior Publication Data

US 2014/0048158 A1 Feb. 20, 2014

Related U.S. Application Data

(60) Provisional application No. 61/684,394, filed on Aug. 17, 2012.

(51) Int. Cl.

| | |
|---|---|
| ***E21B 21/08*** | (2006.01) |
| ***E21B 34/16*** | (2006.01) |
| ***E21B 34/08*** | (2006.01) |
| ***E21B 33/068*** | (2006.01) |
| ***E21B 34/02*** | (2006.01) |

(52) U.S. Cl.

CPC ..... *E21B 34/08* (2013.01); *E21B 33/068* (2013.01); *E21B 34/02* (2013.01); *Y10T 137/7837* (2015.04)

(58) Field of Classification Search

CPC ..... E21B 21/08; E21B 21/10; E21B 34/16

See application file for complete search history.

(56) References Cited

U.S. PATENT DOCUMENTS 345,420 A 7/1886 Eskholme et al.
375,464 A 12/1887 Thacher et al.

(Continued)

FOREIGN PATENT DOCUMENTS

AU 1320088 A 9/1988
AU 649744 B2 6/1994

(Continued)

OTHER PUBLICATIONS

Abstract of Russian Patent document RU2367771 dated Sep. 20, 2009, Titled "Equipment System for Gas Field Well Controlling".

(Continued)

*Primary Examiner* — Catherine Loikith

(74) *Attorney, Agent, or Firm* — Haynes and Boone, LLP

(57) ABSTRACT

A pressure relief valve system for use in a downhole operation may include a pressure relief valve configured to relieve pressure from high pressure tubing extending between a pump and a wellhead, and may include a sensor operably disposed to detect pressure in the high pressure tubing. The pressure relief valve system also may include a controller having a pressure threshold stored therein. The controller may be configured to receive data from the sensor and compare the detected pressure to the stored pressure threshold. A valve actuation system may be in communication with the pressure relief valve and in communication with the controller. The valve actuation system may be configured to change the state of the pressure relief valve from a closed state to an open state in response to a command signal from the controller.

54 Claims, 8 Drawing Sheets

(56) References Cited

U.S. PATENT DOCUMENTS 580,226 A 4/1897 Sanford
741,477 A 10/1903 Flinn
1,201,022 A 10/1916 Conniff
1,379,092 A 5/1921 Fraccascia et al.
1,452,603 A 4/1923 Himes
1,473,634 A 11/1923 Loudon
1,483,001 A 2/1924 Kurre
1,488,211 A 3/1924 Loeffler
1,543,637 A 6/1925 Woll
1,607,463 A 11/1926 Kent
1,664,493 A 4/1928 Smith
1,675,808 A 7/1928 Kliss
1,764,936 A 6/1930 Dean
1,798,498 A 3/1931 Riley
D86,952 S 5/1932 Garrison
1,889,256 A 11/1932 Lipscomb et al.
1,990,090 A 2/1935 Packard
2,197,320 A 4/1940 Shenton
2,310,583 A 2/1943 Johnson
2,310,813 A 2/1943 Sellmeyer
2,339,287 A 1/1944 Neef, Jr.
2,354,161 A 7/1944 Waterman
2,361,881 A 10/1944 Sheppard
2,391,266 A 12/1945 Parker
2,404,142 A 7/1946 Parker
D150,466 S 8/1948 Schuler
2,506,162 A 5/1950 Metzgar
2,576,431 A 11/1951 White
2,587,212 A 2/1952 Placette
2,589,144 A 3/1952 Russell et al.
2,606,068 A 8/1952 Bonacor
2,612,340 A 9/1952 Laurent
2,663,458 A 12/1953 MacGlashan, Jr.
2,694,503 A 11/1954 Young et al.
2,717,001 A 9/1955 Perrault
2,746,773 A 5/1956 Bily
2,766,999 A 10/1956 Watts et al.
2,795,459 A 6/1957 Cornelius
2,923,317 A 2/1960 McInerney
2,925,827 A 2/1960 Anderson et al.
2,969,492 A 1/1961 Wheatley
3,024,047 A 3/1962 Schmohl
3,060,961 A 10/1962 Conley
3,061,267 A 10/1962 Hamer
3,064,940 A 11/1962 Anderson et al.
3,072,379 A 1/1963 Hamer
3,108,939 A 10/1963 Sabins
3,113,792 A 12/1963 Brown
3,150,681 A 9/1964 Hansen et al.
3,160,426 A 12/1964 Faeser
3,194,589 A 7/1965 Kahlbau et al.
3,204,484 A 9/1965 Gustafson et al.
3,216,746 A 11/1965 Watts
3,228,334 A 1/1966 Oss
3,238,687 A 3/1966 Tisbo
3,241,567 A 3/1966 Pusch et al.
3,294,425 A 12/1966 Franck
3,341,232 A 9/1967 Deakins
3,343,802 A 9/1967 Schuilwerve
3,346,002 A 10/1967 Thompson, Jr. et al.
3,357,679 A 12/1967 Gulick
3,403,931 A 10/1968 Crain et al.
3,404,698 A 10/1968 Rouse
3,425,661 A 2/1969 Mayo
3,439,897 A 4/1969 Priese et al.
3,455,534 A 7/1969 Scaramucci
3,467,224 A 9/1969 Curtis et al.
3,472,479 A 10/1969 Sherwood
3,554,581 A 1/1971 Mason et al.
3,556,474 A 1/1971 Scaramucci
3,561,727 A 2/1971 Scaramucci
3,571,896 A 3/1971 Wilkerson
3,594,835 A 7/1971 Wilson
3,630,483 A 12/1971 Canalizo
3,680,188 A 8/1972 Mason et al.
3,687,415 A 8/1972 Turkot
3,712,585 A 1/1973 Grenier
3,726,314 A 4/1973 Moen
3,789,872 A 2/1974 Elliott
3,813,733 A 6/1974 Flohr
3,830,306 A 8/1974 Brown
3,840,048 A 10/1974 Moen
3,845,876 A 11/1974 Needham et al.
3,845,879 A 11/1974 Dernbach et al.
3,881,480 A 5/1975 Lafourcade
3,894,718 A 7/1975 Koch et al.
3,901,259 A 8/1975 Banbury
3,916,950 A 11/1975 Mongerson et al.
3,933,172 A 1/1976 Allen
3,934,608 A 1/1976 Guyton
3,937,240 A 2/1976 Nanny
3,942,551 A 3/1976 Schuller et al.
3,967,842 A 7/1976 Kendrick
3,972,364 A 8/1976 Brumm
3,974,848 A 8/1976 Wheatley
4,022,427 A 5/1977 Read
4,027,696 A 6/1977 Guyton
4,046,164 A 9/1977 Pool
4,059,872 A 11/1977 Delesandri
4,085,770 A 4/1978 Woronowicz
4,086,803 A 5/1978 Wheeler
4,093,180 A 6/1978 Strabala
4,109,714 A * 8/1978 Greenlee ..... E21B 34/16 137/487
4,113,228 A 9/1978 Frye
4,146,047 A 3/1979 Wood et al.
4,150,847 A 4/1979 De Cenzo
4,171,095 A 10/1979 Filan et al.
4,218,080 A 8/1980 Kendrick
4,221,204 A 9/1980 Meyer
4,254,793 A 3/1981 Scaramucci
4,261,387 A 4/1981 Cohn
4,274,434 A 6/1981 Hafele
4,286,621 A 9/1981 Glahn
4,308,916 A 1/1982 Fritz
4,321,945 A 3/1982 Chabat-Courrede
4,327,768 A 5/1982 Behle
4,332,370 A 6/1982 Williams
4,338,707 A 7/1982 Byerly
4,367,571 A 1/1983 Speirs et al.
4,378,849 A 4/1983 Wilks
4,399,830 A 8/1983 Brodie
4,445,255 A 5/1984 Olejak, I
4,448,148 A 5/1984 Gain, Jr.
4,478,388 A 10/1984 George
4,485,530 A 12/1984 Begley et al.
4,485,843 A 12/1984 Wolff
4,497,344 A 2/1985 Kisiel
4,501,291 A 2/1985 Siegrist
4,506,696 A 3/1985 Von Pechmann
4,511,120 A 4/1985 Conley et al.
4,524,599 A 6/1985 Bailey
4,531,542 A 7/1985 Looney
4,572,237 A 2/1986 Thompson
4,590,957 A 5/1986 McFarlane
4,597,505 A 7/1986 Mozley et al.
4,605,036 A 8/1986 Smith et al.
4,616,803 A 10/1986 Schils
4,662,603 A 5/1987 Etheridge
4,667,570 A 5/1987 Jensen, Jr. et al.
4,705,306 A 11/1987 Guido et al.
4,716,930 A 1/1988 Richmond et al.
4,732,215 A 3/1988 Hopper
4,836,240 A 6/1989 Elliott
4,842,014 A 6/1989 Strelow et al.
4,848,398 A 7/1989 Leach
4,850,392 A 7/1989 Crump et al.
4,864,696 A 9/1989 Mittermaier et al.
4,896,367 A 1/1990 Newton et al.
4,915,418 A 4/1990 Palatchy
4,969,482 A 11/1990 Perrin et al.
4,993,489 A 2/1991 McLeod
5,025,865 A 6/1991 Caldwell et al.
5,046,525 A 9/1991 Powell

(56) References Cited

U.S. PATENT DOCUMENTS 5,056,548 A 10/1991 Mills
5,143,112 A 9/1992 Scaramucci
5,161,566 A 11/1992 Scaramucci
5,161,570 A 11/1992 Scaramucci
5,165,478 A 11/1992 Wilson
5,178,185 A 1/1993 Stehling et al.
5,199,464 A 4/1993 Savard
5,307,835 A 5/1994 Scaramucci
5,341,840 A 8/1994 Manson et al.
5,386,847 A 2/1995 Scaramucci
5,417,402 A 5/1995 Speybroeck
D360,728 S 7/1995 Nozaki
5,439,027 A 8/1995 Layton et al.
5,441,072 A 8/1995 Indey et al.
5,443,088 A 8/1995 Hoch et al.
5,462,413 A 10/1995 Schroeder
5,477,752 A 12/1995 West et al.
5,507,533 A 4/1996 Mumma
5,522,420 A 6/1996 Martin
5,526,883 A 6/1996 Breaux
5,538,296 A 7/1996 Horton
5,544,675 A 8/1996 Dean
5,584,315 A 12/1996 Powell
5,603,485 A 2/1997 Schwarz
5,676,348 A 10/1997 Ungchusri et al.
5,685,334 A 11/1997 Hagan
5,689,862 A 11/1997 Hayes et al.
5,755,427 A 5/1998 Koskinas
5,787,926 A 8/1998 Mukumoto et al.
5,791,693 A 8/1998 Crawford
5,832,947 A 11/1998 Niemczyk
5,947,152 A 9/1999 Martin et al.
5,957,592 A 9/1999 Yamanaka
5,971,007 A 10/1999 Harcourt et al.
5,983,826 A 11/1999 Lohde
6,003,837 A 12/1999 Raymond, Jr. et al.
6,029,693 A 2/2000 Nakanishi et al.
6,079,439 A 6/2000 Hartley
6,082,707 A 7/2000 Hosie et al.
6,085,572 A 7/2000 McGuire, Sr. et al.
6,089,531 A 7/2000 Young
6,155,091 A 12/2000 Hayes et al.
6,164,707 A 12/2000 Ungchusri et al.
6,209,561 B1 4/2001 Kugelev et al.
6,230,733 B1 5/2001 Strelow et al.
6,240,951 B1 6/2001 Yori
6,250,605 B1 6/2001 Young
6,290,237 B1 9/2001 Graupner
6,361,051 B1 3/2002 Babin
6,371,527 B1 4/2002 Ungchusri et al.
6,382,247 B1 5/2002 Gundry
6,387,226 B1 5/2002 Persson
6,450,477 B1 9/2002 Young
6,554,024 B2 4/2003 Mefford et al.
6,554,249 B2 4/2003 Pang et al.
6,742,538 B1 6/2004 Aderholt et al.
6,752,377 B1 6/2004 Taylor
6,770,177 B2 8/2004 Keller et al.
6,843,265 B2 1/2005 Taylor
6,854,704 B1 2/2005 Young
6,880,567 B2 4/2005 Klaver et al.
6,880,568 B1 4/2005 Taylor
6,886,593 B2 5/2005 Madden et al.
6,945,569 B1 9/2005 Diaz et al.
6,948,526 B2 9/2005 Seder et al.
6,978,799 B2 12/2005 Kugelev et al.
7,004,445 B2 2/2006 Lymberopoulos
7,028,778 B2 4/2006 Krywitsky
7,028,986 B2 4/2006 Young
7,204,525 B2 4/2007 Matzner
RE39,695 E 6/2007 Ungchusri et al.
7,228,869 B2 6/2007 Wilhelm
D549,850 S 8/2007 Perlman
7,264,059 B2 9/2007 Akselberg
7,285,190 B2 10/2007 Martin, Jr. et al.
7,302,961 B2 12/2007 Martin et al.
D570,501 S 6/2008 Janesz et al.
7,398,796 B2 7/2008 Hjorth et al.
7,401,819 B2 7/2008 Gibb et al.
7,451,959 B2 11/2008 Matzner
7,458,212 B2 12/2008 Koizumi et al.
7,516,941 B2 4/2009 Combs
7,549,681 B1 6/2009 Matzner
7,677,526 B2 3/2010 Lymberopoulos
7,819,386 B2 10/2010 Combs
7,823,265 B2 11/2010 Matzner et al.
7,890,276 B2 2/2011 Killion et al.
7,950,409 B2 5/2011 Stokes et al.
8,000,909 B2 8/2011 Danzy
8,051,875 B2 11/2011 Edwards
D660,461 S 5/2012 Kotin et al.
D660,984 S 5/2012 Kotin et al.
8,196,229 B1 6/2012 Hickok
D666,326 S 8/2012 Sims
8,261,771 B2 9/2012 Witkowski et al.
D675,750 S 2/2013 King
8,376,046 B2 2/2013 Broussard, II
8,465,001 B2 6/2013 Witkowski et al.
8,469,108 B2 6/2013 Kajaria et al.
8,474,521 B2 7/2013 Kajaria et al.
8,490,949 B2 7/2013 Lanning et al.
D703,294 S 4/2014 Witkowski
D707,332 S 6/2014 Witkowski
D707,797 S 6/2014 Wilkowski
2002/0179876 A1 12/2002 Pang et al.
2002/0185867 A1 12/2002 Stachowiak
2002/0186910 A1 12/2002 Maret
2003/0047944 A1 3/2003 Ungchusri et al.
2003/0178067 A1 9/2003 Fredrickson et al.
2004/0163716 A1 8/2004 Madden et al.
2005/0087232 A1 4/2005 Kugelev
2005/0121073 A1 6/2005 Carroll
2005/0199286 A1 9/2005 Appleford et al.
2006/0091339 A1 5/2006 Young
2006/0185731 A1 8/2006 Grable et al.
2006/0266422 A1 11/2006 Feenstra et al.
2006/0278394 A1* 12/2006 Stover ..... 166/308.1
2006/0283513 A1 12/2006 Kurian et al.
2007/0029090 A1 2/2007 Andreychuk et al.
2007/0051411 A1 3/2007 Scaramucci et al.
2007/0205387 A1 9/2007 Grau et al.
2007/0262029 A1 11/2007 Yoshida et al.
2007/0272308 A1 11/2007 Spears et al.
2008/0039802 A1 2/2008 Vangsness et al.
2008/0054204 A1 3/2008 Zhou
2008/0142752 A1 6/2008 Matzner
2008/0196773 A1 8/2008 Franconi
2008/0264649 A1 10/2008 Crawford
2008/0295910 A1 12/2008 Aleksandersen et al.
2008/0308159 A1 12/2008 Stunkard
2009/0008934 A1 1/2009 Matzner et al.
2009/0120635 A1 5/2009 Neal
2010/0154894 A1 6/2010 Kotapish
2010/0193057 A1 8/2010 Garner et al.
2010/0258200 A1 10/2010 Walker et al.
2010/0288493 A1* 11/2010 Fielder et al. ..... 166/250.15
2010/0326541 A1 12/2010 Kugelev et al.
2011/0036415 A1 2/2011 Lymberopoulos
2011/0061871 A1 3/2011 Omvik
2011/0240126 A1 10/2011 Lymberopoulos et al.
2011/0272158 A1 11/2011 Neal
2011/0316274 A1 12/2011 Groenlund et al.
2012/0025114 A1 2/2012 Lymberopoulos et al.
2012/0031494 A1 2/2012 Lymberopoulos
2012/0060929 A1 3/2012 Kendrick
2012/0073670 A1 3/2012 Lymberopoulos
2012/0085541 A1 4/2012 Love et al.
2012/0091743 A1 4/2012 Ohman, III et al.
2012/0181013 A1 7/2012 Kajaria et al.
2012/0181015 A1 7/2012 Kajaria et al.
2012/0181016 A1 7/2012 Kajaria et al.
2012/0219354 A1 8/2012 Bauer et al.
2012/0227983 A1 9/2012 Lymberopoulos et al.
2012/0255734 A1 10/2012 Coli et al.

(56) References Cited

U.S. PATENT DOCUMENTS

| | | | |
|---|---|---|---|
| 2012/0298213 | A1 | 11/2012 | Forster et al. |
| 2012/0325332 | A1 | 12/2012 | Ball et al. |
| 2013/0000745 | A1 | 1/2013 | Witkowski et al. |
| 2013/0020519 | A1 | 1/2013 | Lymberopoulos |
| 2013/0037125 | A1 | 2/2013 | Drake et al. |
| 2013/0248182 | A1 | 9/2013 | Chong et al. |
| 2013/0299727 | A1 | 11/2013 | Witkowski |
| 2014/0048255 | A1 | 2/2014 | Baca et al. |
| 2014/0048734 | A1 | 2/2014 | Witkowski et al. |
| 2015/0000766 | A1 | 1/2015 | Arizpe et al. |
| 2015/0042088 | A1 | 2/2015 | Witkowski et al. |

FOREIGN PATENT DOCUMENTS

| | | | |
|---|---|---|---|
| AU | 348253 | | 5/2013 |
| CA | 2350047 | | 12/2001 |
| CA | 2635751 | A1 | 12/2001 |
| CA | 2636751 | A1 | 1/2009 |
| CA | 2490664 | C | 11/2009 |
| CA | 2485817 | C | 8/2010 |
| CA | 2654848 | A1 | 8/2010 |
| CA | 2503231 | C | 6/2011 |
| CA | 2612397 | C | 4/2013 |
| CA | 149748 | | 11/2014 |
| CA | 152956 | | 11/2014 |
| CA | 152957 | | 11/2014 |
| CN | 2118877 | U | 10/1992 |
| CN | 1137309 | A | 12/1996 |
| CN | 1225298 | A | 8/1999 |
| CN | 2426550 | Y | 4/2001 |
| CN | 1548701 | A | 11/2004 |
| CN | 2901281 | | 5/2007 |
| CN | 200999609 | Y | 1/2008 |
| CN | 201043685 | | 4/2008 |
| CN | 101205798 | A | 6/2008 |
| CN | 101258350 | A | 9/2008 |
| CN | 101303033 | A | 11/2008 |
| CN | 101367099 | A | 2/2009 |
| CN | 201206648 | Y | 3/2009 |
| CN | 201262043 | Y | 6/2009 |
| CN | 101539218 | | 9/2009 |
| CN | 101722221 | A | 6/2010 |
| CN | 201496006 | U | 6/2010 |
| CN | 201545914 | U | 8/2010 |
| CN | 201650157 | U | 11/2010 |
| CN | 201739525 | U | 2/2011 |
| CN | 201747313 | | 2/2011 |
| CN | 202047762 | U | 11/2011 |
| CN | 102323158 | | 1/2012 |
| CN | 202144943 | | 2/2012 |
| CN | 202208237 | U | 5/2012 |
| CN | 202255397 | U | 5/2012 |
| CN | 202255848 | | 5/2012 |
| CN | 202718658 | | 2/2013 |
| CN | ZL2013300399164 | | 9/2013 |
| CN | ZL201330441389 | | 4/2014 |
| CN | ZL201080025350.3 | | 5/2014 |
| CN | ZL201330441241.6 | | 5/2014 |
| CN | ZL2010800253503 | | 5/2014 |
| CN | ZL2013304412416 | | 5/2014 |
| DE | 1166571 | B | 3/1964 |
| DE | 2415732 | A1 | 10/1974 |
| DE | 2358756 | A1 | 3/1975 |
| DE | 2558272 | A1 | 7/1977 |
| DE | 2642743 | A1 | 3/1978 |
| DE | 218416 | A1 | 2/1985 |
| DE | 3341643 | A1 | 5/1985 |
| DE | 19707228 | A1 | 8/1998 |
| DE | 102004033453 | | 1/2006 |
| EA | 201171356 | A1 | 5/2012 |
| EM | EU002185371-001 | | 2/2013 |
| EM | 002307421-0001 | | 9/2013 |
| EM | 002307421-0002 | | 9/2013 |
| EP | 0044619 | A1 | 1/1982 |
| EP | 0559131 | B1 | 1/1996 |
| EP | 1219942 | B1 | 8/2004 |
| EP | 1488867 | A1 | 12/2004 |
| FR | 2635476 | A1 | 2/1990 |
| GB | 255970 | A | 8/1926 |
| GB | 578008 | A | 6/1946 |
| GB | 619950 | A | 3/1949 |
| GB | 731895 | A | 6/1955 |
| GB | 1536728 | A | 12/1978 |
| GB | 2056626 | A | 3/1981 |
| GB | 2117822 | A | 10/1983 |
| GB | 2140338 | A | 11/1984 |
| GB | 2185287 | A | 7/1987 |
| GB | 2228885 | A | 9/1990 |
| GB | 2312728 | B | 5/2000 |
| GB | 2355510 | A | 4/2001 |
| GB | 2408562 | A | 1/2005 |
| GB | 2416574 | B | 8/2008 |
| GB | 2413606 | B | 3/2009 |
| GB | 2444822 | B | 6/2011 |
| GB | 2452801 | B | 4/2012 |
| GB | 2493900 | A | 2/2013 |
| IN | 251691 | | 8/2012 |
| JP | 53108873 | A | 9/1978 |
| JP | 53125261 | A | 11/1978 |
| JP | 57073187 | | 5/1982 |
| JP | 57079400 | | 5/1982 |
| JP | 61093344 | | 5/1986 |
| JP | 5033883 | A | 2/1993 |
| JP | 08075022 | | 3/1996 |
| JP | 08128536 | | 5/1996 |
| JP | 08291543 | | 5/1996 |
| JP | 08300052 | | 11/1996 |
| JP | 10175026 | | 6/1998 |
| JP | 2000330646 | | 11/2000 |
| JP | 2001355774 | | 12/2001 |
| JP | 2002098068 | | 4/2002 |
| JP | 2004190769 | A | 7/2004 |
| JP | 2006194334 | A | 7/2006 |
| JP | D1285004 | | 9/2006 |
| JP | 2008215626 | A | 9/2008 |
| JP | 4996990 | B2 | 5/2012 |
| KR | 100540389 | B1 | 12/2005 |
| KR | 100540390 | B1 | 12/2005 |
| KR | 100540392 | B1 | 12/2005 |
| KR | 100621158 | B1 | 8/2006 |
| KR | 100716760 | B1 | 5/2007 |
| KR | 100832065 | B1 | 5/2008 |
| KR | 101191630 | B1 | 10/2012 |
| MX | 2011011007 | A | 2/2012 |
| MX | 2011012944 | A | 6/2012 |
| MX | 40533 | | 12/2013 |
| RU | 1466084 | C | 6/1995 |
| RU | 1417281 | C | 7/1995 |
| RU | 2088831 | C1 | 8/1997 |
| RU | 2242313 | C2 | 12/2004 |
| SG | 175263 | | 11/2012 |
| SG | 176534 | | 11/2012 |
| SG | D2013/186 | G | 2/2013 |
| SU | 567001 | A1 | 7/1977 |
| SU | 585898 | A1 | 12/1977 |
| SU | 1391769 | A1 | 4/1988 |
| SU | 1721368 | A1 | 3/1992 |
| WO | WO-9713398 | A2 | 4/1997 |
| WO | WO9956047 | | 11/1999 |
| WO | WO-2009023042 | A1 | 2/2009 |
| WO | WO-2010080636 | A2 | 7/2010 |
| WO | WO-2010123889 | A2 | 10/2010 |
| WO | WO-2010141651 | A2 | 12/2010 |
| WO | WO-2010151680 | A2 | 12/2010 |
| WO | WO-2011095453 | A1 | 8/2011 |
| WO | WO-2013023154 | A1 | 2/2013 |
| WO | WO-2014028498 | | 2/2014 |
| WO | WO-2014028795 | | 2/2014 |
| WO | WO-2015002863 | A1 | 1/2015 |

OTHER PUBLICATIONS

Abstract of Russian Patent document RU2367770 dated Sep. 20, 2009, Titled "Equipment System for Gas Field Well Controlling".

(56) References Cited

OTHER PUBLICATIONS

"Canadian Examiner's Report issued Feb. 10, 2014, by CIPO, re App No. 152957".
"Eurasian Office Action issued Nov. 19, 2013, by the Eurasian Patent Office, re App No. 201171356".
"International Search Report and Written Opinion by the ISA/US, mailed Feb. 7, 2014, re PCT/US2013/054741".
"Notice of Allowance mailed Feb. 7, 2014, by the USPTO, re U.S. Appl. No. 29/449,852".
"Notice of Allowance mailed Feb. 7, 2014, by the USPTO, re U.S. Appl. No. 29/449,867".
"Notice of Allowance mailed Jan. 16, 2014, by the USPTO, re U.S. Appl. No. 29/453,837".
"Notice of Allowance mailed Nov. 22, 2013, by the USPTO, re U.S. Appl. No. 12/822,900".
"Notice of Allowance mailed Nov. 26, 2013, by the USPTO, re U.S. Appl. No. 29/429,809".
"Office Action mailed Mar. 27, 2014, by the USPTO, re U.S. Appl. No. 13/918,479".
"Russian Office Action, issued by the Russian Patent Office, re App No. 2013500548".
Oksanen: "Singer Model DLA-RPS Air operated Surge Anticipating Electrically Timed Sewage Relief Valve", • Dec. 8, 2010, XP055159354,Retrieved from the Internet: URL:http://cdn2.hubspot.net/hub/230272/file-725480083-pdf/Operation Guides/Relief Operation Guides/A106-DL-ET~IOM-Operation~Guide.pdf?t=1418679634446 [retrieved on Dec. 18, 2014] the whole document.
International Search Report and Written Opinion issued from the European Patent Office regarding PCT/US2013/055257, dated Jan. 23, 2015, 13 pages.
"Advisory Action mailed May 20, 2013, by the USPTO, re U.S. Appl. No. 12/165,680".
An Introduction to Rupture Disk Technology catalog, BS&B Safety Systems, 1994.
"Chinese Office Action dated Jun. 5, 2013, re App No. 2010800253503".
Co-pending U.S. Appl. No. 29/429,809, filed Aug. 16, 2012.
Co-pending U.S. Appl. No. 29/449,852, filed Mar. 15, 2013.
Co-pending U.S. Appl. No. 29/449,867, filed Mar. 15, 2013.
Co-pending U.S. Appl. No. 29/453,837, filed May 3, 2013.
Emergency Relief Valve Brochure, SPM, 1997.
"European Search Report mailed Mar. 14, 2013, re corresponding EP App No. 10767632".
"Examination Report by IP India, dated Apr. 26, 2013, re App No. 251691".
"Extended European Search Report, by the EP Patent Office, dated Mar. 14, 2013, re App No. 10767632.2".
"Extended European Search Report, issued Jul. 4, 2013, re App No. 10784052.2".
"Final Office Action mailed Aug. 16, 2013, by the USPTO, re U.S. Appl. No. 12/822,900".
"Final Office Action mailed Jan. 31, 2012, by the USPTO, re U.S. Appl. No. 12/165,680".
"Final Office Action mailed Mar. 7, 2013, by the USPTO, re U.S. Appl. No. 12/165,680".
"International Preliminary Report on Patentability mailed Jul. 15, 2013, regarding PCT/US2012/050376".
International Search Report and Written Opinion for Application No. PCT/US2009/068822 mailed on Aug. 9, 2010, 7 pages.
International Search Report and Written Opinion for Application No. PCT/US2010/031738 mailed on Dec. 27, 2010, 7 pages.
International Search Report and Written Opinion for Application No. PCT/US2010/037156 mailed on Jan. 13, 2011, 8 pages.
International Search Report and Written Opinion for Application No. PCT/US2010/039834 mailed on Feb. 8, 2011, 6 pages.
International Search Report and Written Opinion for Application No. PCT/US2012/050376 mailed on Oct. 26, 2012, 10 pages.
"Notice of Allowance mailed Aug. 29, 2005, by the USPTO, re U.S. Appl. No. 10/690,888".
"Notice of Allowance mailed Dec. 20, 2012, by the Canadian IP Office, re App No. 2,612,397".
"Notice of Allowance mailed Feb. 11, 2009, by the USPTO, re U.S. Appl. No. 11/414,984".
"Notice of Allowance mailed Feb. 12, 2007, by the USPTO, re U.S. Appl. No. 11/013,486".
"Notice of Allowance mailed Feb. 19, 2013, by the USPTO, re U.S. Appl. No. 12/793,194".
"Notice of Allowance mailed Jul. 6, 2005, by the USPTO, re U.S. Appl. No. 10/833,859".
"Notice of Allowance mailed Jun. 29, 2010, by the USPTO, re U.S. Appl. No. 11/354,663".
"Notice of Allowance mailed May 16, 2012, by the USPTO, re U.S. Appl. No. 12/763,786".
"Notice of Allowance mailed Sep. 23, 2008, by the USPTO, re U.S. Appl. No. 11/638,965".
"Office Action dated May 31, 2011, from the UK IP Office, re App No. GB0812086.7".
"Office Action mailed Apr. 4, 2008, by the USPTO, re U.S. Appl. No. 11/638,965".
"Office Action mailed Aug. 30, 2005, by the USPTO, re U.S. Appl. No. 11/013,486".
"Office Action mailed Aug. 9, 2011, by the USPTO, re U.S. Appl. No. 12/165,680".
"Office Action mailed Dec. 22, 2004, by the USPTO, re U.S. Appl. No. 10/833,859".
"Office Action mailed Dec. 30, 1996, by the USPTO, re U.S. Appl. No. 08/643,239".
"Office Action mailed Dec. 6, 2012, by the USPTO, re U.S. Appl. No. 12/822,900".
"Office Action mailed Jan. 8, 2010, by the USPTO, re U.S. Appl. No. 11/354,663".
"Office Action mailed Jul. 12, 2013, by the USPTO, re U.S. Appl. No. 12/165,680".
"Office Action mailed Mar. 19, 2012, by the USPTO, re U.S. Appl. No. 12/642,541".
"Office Action mailed Nov. 17, 1983, by the USPTO, re U.S. Appl. No. 06/419,141".
"Office Action mailed Oct. 11, 2011, by the USPTO, re U.S. Appl. No. 12/763,786".
"Office Action mailed Oct. 25, 2012, by the USPTO, re U.S. Appl. No. 12/793,194".
"Office Action mailed Sep. 13, 2013, by the USPTO, re U.S. Appl. No. 13/608,562".
One page showing 4" Halliburton Big Inch Clamp Connection.
Pop Off Valve information, BJ 285959, BJ Services.
Reset Relief Valves brochure, Harrisburg, Inc., 1982.
SPM Flow Control, Inc., 4-Inch Integral Swivel Joint.
SPM Flow Control, Inc., "Flow Control Products and Drilling Equipment for the Worldwide Petroleum Industry," [Online] Jan. 8, 2007, <URL:www.spmflo.com>.
SPM Flow Control, Inc., High-Pressure Long Radius Swivel Joints, 2002, www.spmflo.corn.
SPM Flow Control, Inc., Long Radius Swivel Joints, H2S, Operating and Maintenance Instructions, 1999.
SPM Flow Control, Inc., Long Radius Swivel Joints, Operating and Maintenance Instructions, 2004.
SPM Flow Control, Inc., Long Radius Swivel Joints, Operating and Maintenance Instructions, 2006.
SPM Flow Control, Inc., Swivel Joints, 1999, www.spmflo.com.
SPM Flow Control, Inc., Weir SPM, Long Radius Swivel Joints, 2007.
Supplementary European Search Report for Application No. EP09838004 mailed on Jan. 30, 2013, 4 pages.
Two-pp. Of Grayloc Products, Houston, Texas 77252 showing Grayloc Connectors in Extreme Service.
"U.S. Appl. No. 60/653,014, filed Feb. 15, 2005, "Flowline Torque Arm Assembly"".
"U.S. Appl. No. 60/947,738, filed Jul. 3, 2007, "Swivel Joint with Uniform Ball Bearing Requirements"".
"U.S. Appl. No. 61/170,917, filed Apr. 20, 2009, "Flowline Flapper Valve"".

(56) References Cited

OTHER PUBLICATIONS

"U.S. Appl. No. 61/220,067, filed Jun. 24, 2009, "Stand for Pressure Relief Valve"".
"U.S. Appl. No. 61/522,234, filed Aug. 10, 2011, "Rupture Disk Relief Valve"".
Valve illustration, Retsco Inc., 1992.
Venture Oilfield Services Ltd. Drawing Titled: Flowline's Safety Clamp.
"10 Station AFAM Trailer, FMC, Oct. 28, 2011, 6 pages".
"Australian Exam Report, issued Sep. 25, 2014, by IP Australia, re App No. 2010239366".
"Brazil Office Action, dated Jun. 3, 2014, re App No. BR3020130006611".
"Canadian Exam Report dated Jul. 29, 2014, issued by CIPO, re App No. 2636751".
"Canadian Examination Report, by CIPO, mailed Feb. 10, 2014, re App No. 152956".
"Canadian Examination Report dated Apr. 28, 2014, by the CIPO, re App No. 2764310".
"Canadian Examination Report dated Feb. 7, 2014, by the CIPO, re App No. 149748".
"Second Written Opinion, by the IPEA/US, mailed Jul. 28, 2014, re PCT/US2013/054741".
"European Exam Report, by the EPO, dated Apr. 8, 2014, re App No. 10784052.2".
"Final Office Action mailed Apr. 25, 2014, by the USPTO, re U.S. Appl. No. 13/608,562".
"Final Office Action mailed Feb. 28, 2014, by the USPTO, re U.S. Appl. No. 12/165,680".
"Final Office Action mailed Jan. 5, 2015, by the USPTO, re U.S. Appl. No. 13/572,293".
"Final Office Action mailed Nov. 6, 2014, by the USPTO, re U.S. Appl. No. 13/965,848".
"International Preliminary Report on Patentability, by the IPEA/US, mailed Nov. 17, 2014, re PCT/US2013/054741".
"International Search Report and Written Opinion by the ISA/US, mailed Dec. 16, 2014, re PCT/US2014/044813".
"Notice of Allowance mailed Apr. 10, 2015, by the USPTO, re U.S. Appl. No. 29/493,861".
"Notice of Allowance mailed Apr. 9, 2015, by the USPTO, re U.S. Appl. No. 13/965,848".
"Notice of Allowance mailed Dec. 17, 2014, by the Canadian IP Office, re App No. 2764310".
"Notice of Allowance mailed Dec. 26, 2014, by the USPTO, re U.S. Appl. No. 13/918,479".
"Notice of Allowance mailed Jun. 25, 2014, by the USPTO, re U.S. Appl. No. 12/165,680".
"Notice of Allowance mailed Nov. 28, 2014, by the USPTO, re U.S. Appl. No. 13/608,562".
"Office Action mailed Jul. 31, 2014, by the USPTO, re U.S. Appl. No. 13/965,848".
"Office Action mailed Jun. 18, 2014, by the USPTO, re U.S. Appl. No. 13/572,293".
"Weir SPM Safety Iron Manifold Trailer, 2008, 2 pages".

* cited by examiner

AUTOMATED RELIEF VALVE CONTROL SYSTEM AND METHOD

PRIORITY

This application claims priority to and the benefit of the filing date of U.S. Provisional Patent Application 61/684,394, filed Aug. 17, 2012, incorporated herein by reference.

TECHNICAL FIELD

This disclosure relates in general to a valve control system and method and, in particular, to an automated relief valve control system and method.

BACKGROUND OF THE DISCLOSURE

Hydraulic fracturing to stimulate a subterranean formation includes injecting a fracturing fluid through a wellbore into the formation at a pressure and flow rate at least sufficient to overcome the pressure of the reservoir and extend fractures into the formation. A high pressure line directs the fracturing fluid through a wellhead and into the wellbore. The fracturing fluid is a mixture of a liquid and a media, and is typically injected into the wellbore at high pressures, in the range of about 15000 psi.

To protect the integrity of the wellhead and to reduce equipment failures, such as blown tubing or pumps, a relief valve associated with the high pressure line in the system maintains pressure at or below a rated limit for the associated fracturing equipment. However, the relief valve has traditionally been difficult to calibrate in the field and is subject to wear as pressure fluctuations occur, resulting in valve chatter, increased wear, and ultimately a less than accurate popoff pressure limit on the relief valve. Therefore, what is needed is an apparatus or method that addresses one or more of the foregoing issues, among others.

SUMMARY

In an exemplary aspect, the present disclosure is directed to a pressure relief valve system for use in a downhole operation that may include a pressure relief valve configured to relieve pressure from high pressure tubing extending between a pump and a wellhead, and may include a sensor operably disposed to detect pressure in the high pressure tubing. The pressure relief valve system also may include a controller having a pressure threshold stored therein. The controller may be configured to receive data from the sensor and compare the detected pressure to the stored pressure threshold. A valve actuation system may be in communication with the pressure relief valve and in communication with the controller. The valve actuation system may be configured to change the state of the pressure relief valve from a closed state to an open state in response to a command signal from the controller.

In one aspect, the controller is configured to emit the command signal when the controller determines that the detected pressure exceeds the stored pressure threshold. In another aspect, the valve actuation system comprises a dump valve that receives the command signal from the controller.

In yet another aspect, the valve actuation system may include an input portion connected to a gas source, an output portion connected to the pressure relief valve, and a reducing valve disposed between the input portion and the output portion. The reducing valve may be configured to adjust the pressure in the output portion based on data from the controller. The valve actuation system may comprise a second controller configured to determine a suitable pressure for the output portion. The second controller may be configured to adjust the reducing valve to achieve the suitable pressure in the output portion. The suitable pressure may be about 105-150% of a gas pressure threshold that opens the relief valve. In an aspect, the pressure relief valve system may further include a first pressure transmitter configured to detect pressure of the output portion and a second pressure transmitter configured to detect pressure of the input portion.

In one aspect, controller may be configured to receive an operator input that sets said pressure threshold. The controller also may be configured to receive an operator input that sets a reset pressure for the pressure relief valve. In one aspect, the controller may be operable via a touch screen interface. In one aspect, the controller may be configured to average the detected pressure over an increment of time and compare the average detected pressure to the stored pressure threshold. In another aspect, the control box may receive data directly from the sensor.

In an aspect, the system includes an actuation fluid source in communication with the valve actuation system, the actuation fluid source providing fluid pressurized to maintain the state of the pressure relief valve in a closed state. In an aspect, the system includes a regulator structure carrying the valve actuation system and the actuation fluid source in a single transportable unit. In an aspect, the regulator structure is a skid. In an aspect, the regulator structure comprises a hose reel carrying a hose extendable between the valve actuation system and the pressure relief valve and configured to place the valve actuation system and the pressure relief valve in fluid communication, and a data cable reel carrying a data cable extendable between the valve actuation system and the controller and configured to place the valve actuation system and the controller in electrical communication. In an aspect, the system includes a user interface in communication with the controller, wherein the regulator structure carries the controller and includes a hose reel carrying a hose extendable between the valve actuation system and the pressure relief valve and configured to place the valve actuation system and the pressure relief valve in fluid communication, and a data cable reel carrying a data cable extendable between the controller and the user interface and configured to place the controller and the user interface in electrical communication.

In an exemplary aspect, the present disclosure is directed to a method of controlling a pressure relief valve. The method may include maintaining a pressure relief valve in a closed state with a pressurized gas, detecting, with a pressure sensor disposed adjacent the pressure relief valve, a fluid pressure in a high pressure tube extending between a pump and a wellhead, comparing the detected pressure to a stored fluid pressure threshold, sending a signal to open a dump valve if the detected pressure exceeds the fluid pressure threshold, and opening the dump valve to lower the pressure of the pressurized gas until the pressure relief valve changes from the closed state to the open state.

In one aspect, the method may include prompting an operator to enter the fluid pressure threshold, prompting an operator to enter a reset pressure threshold, and closing the dump valve to increase the pressure of the pressurized gas when the detected fluid pressure is below the reset pressure threshold.

The method also may include regulating the pressure of the pressurized gas that maintains the pressure relief valve in a closed state with a reducing valve, and controlling the reducing valve with an electronic controller in response to the fluid pressure threshold. In some aspects, regulating the pressure of the pressurized gas may comprise maintaining the pressurized gas at a pressure about 105-150% of a gas pressure threshold that opens the relief valve. The method also may include changing the pressure of the pressurized gas with the reducing valve in response to changes in the fluid pressure threshold.

In one aspect, detecting the pressure of fluid may include averaging the pressure over an increment of time to obtain the average pressure, and wherein comparing the detected pressure to a fluid pressure threshold comprises comparing the average pressure to the fluid pressure threshold.

In an exemplary aspect, the present disclosure is directed to a frac site having a pressure relief valve system for high pressure frac tubing. The frac site may include a pressure relief valve configured to relieve pressure from the high pressure frac tubing extending between a frac pump and a wellhead, a sensor operably disposed to detect pressure in the high pressure frac tubing, and a user interface configured to receive operator inputs representing a desired pressure threshold from an operator. The frac site also may include a controller configured to receive the desired pressure threshold entered at the user interface, configured to receive data from the sensor representing a detected pressure, and configured to compare the detected pressure to the desired pressure threshold. The frac site may further include a valve actuation system in communication with the pressure relief valve and in communication with the controller. The valve actuation system may be configured to change the state of the pressure relief valve from a closed state to an open state in response to a command signal from the controller.

In an aspect, the frac site includes a control van with the user interface being disposed in the control van and the valve actuation system being disposed adjacent the pressure relief valve. In another aspect, the valve actuation system may include an input portion connected to a gas source, an output portion connected to the pressure relief valve, and a reducing valve disposed between the input portion and the output portion. The reducing valve may be configured to adjust the pressure in the output portion based on data from the controller.

In an aspect, the frac site may include an actuation fluid source in communication with the valve actuation system, the actuation fluid source providing fluid pressurized to maintain the state of the pressure relief valve in a closed state. In an aspect, a regulator structure may carry the valve actuation system and the actuation fluid source in a single transportable unit. In an aspect, the regulator structure is a skid.

In an aspect, the regulator structure includes a hose reel carrying a hose extendable between the valve actuation system and the pressure relief valve and configured to place the valve actuation system and the pressure relief valve in fluid communication, and includes a data cable reel carrying a data cable extendable between the valve actuation system and the controller and configured to place the valve actuation system and the controller in electrical communication. In an aspect, the regulator structure carries the controller and includes a hose reel carrying a hose extendable between the valve actuation system and the pressure relief valve and configured to place the valve actuation system and the pressure relief valve in fluid communication, and includes a data cable reel carrying a data cable extendable between the controller and the user interface and configured to place the controller and the user interface in electrical communication.

Other aspects, features, and advantages will become apparent from the following detailed description when taken in conjunction with the accompanying drawings, which are a part of this disclosure and which illustrate, by way of example, principles of the inventions disclosed.

DESCRIPTION OF FIGURES

The accompanying drawings facilitate an understanding of the various embodiments.

DETAILED DESCRIPTION

Figure 1:
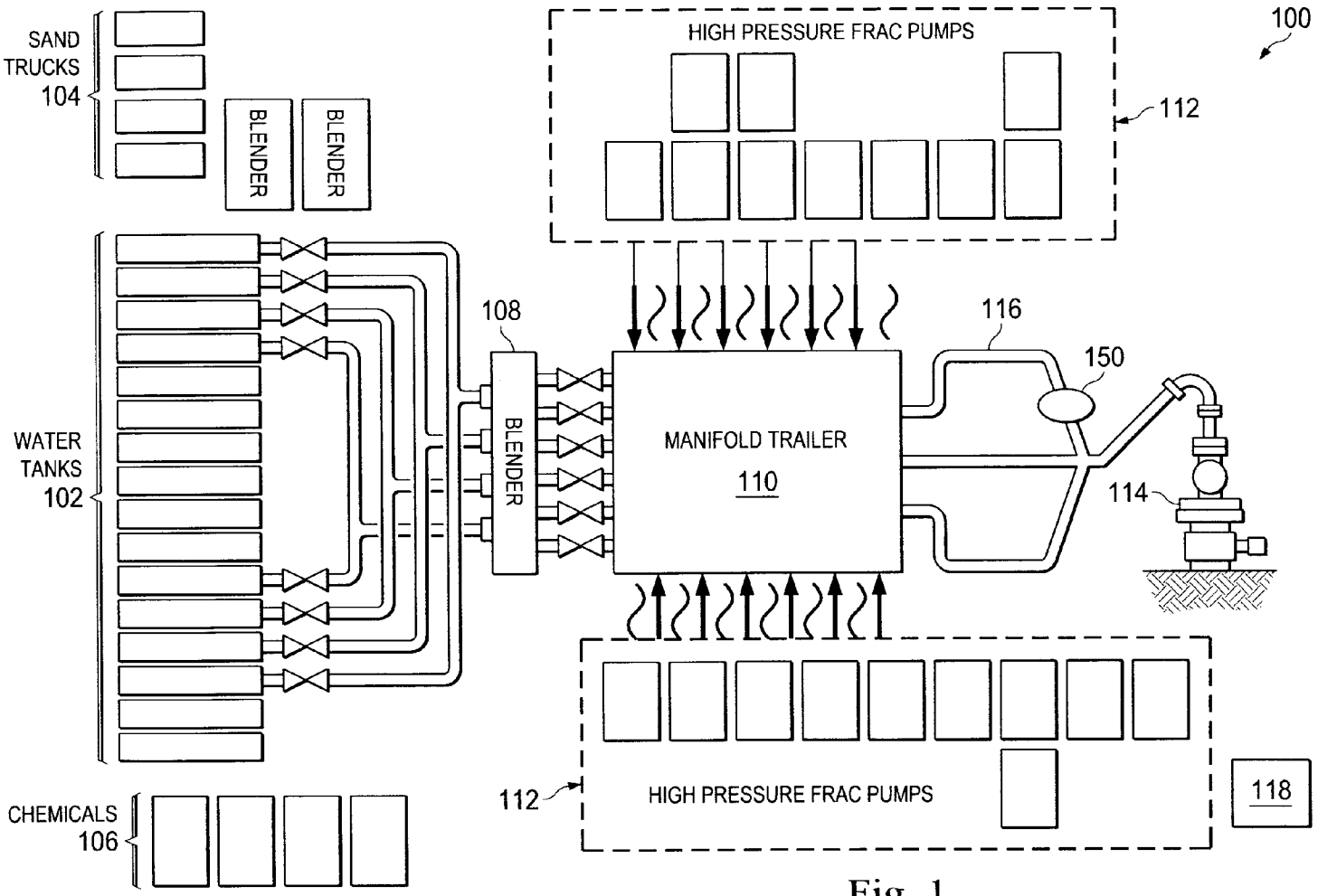
FIG. 1 is a schematic illustrating an exemplary frac site according to an exemplary aspect of the present disclosure.

FIG. 1 illustrates an exemplary frac site incorporating the subject matter of the present disclosure. The frac site, referenced herein by the numeral 100, includes water trucks 102, sand trucks 104, chemicals 106, a blender 108, a manifold trailer 110, and high pressure frac pumps 112. The water, sand, and chemicals are introduced into the blender 108 to create slurry referenced herein as a fracturing or fracing fluid. The fracing fluid is introduced into the manifold trailer 110 and fed from the manifold trailer to high pressure frac pumps 112.

The manifold trailer 110 includes a low pressure section and a high pressure section. The low pressure section transfers low pressure from the blender 108 to the frac pumps 112. The high pressure section transfers the fracing fluid from the frac pumps 112 to a wellhead 114. The high pressure frac pumps 112 receive the mixed fluid from the manifold trailer 110 through a suction manifold and energize the fluid through the power end/fluid end portion of the frac pump 112. Depending on the capacity of the frac pump 112, this pressure can reach up to 15,000 to 30,000 psi. The high pressure fracing fluid is directed from the manifold trailer 110 to the wellhead 114 via a high pressure tubing 116.

In the example of FIG. 1, the frac site includes a data van 118 that operates as a main communication center for the entire frac site 100. The data van 118 may be configured to monitor all aspects of the fracing operation and may be in communication with transducers and controllers disposed about the frac site 100. From the data van 118, an operator may be able to monitor pressures, flows, blending, and other information relating to the frac site 100.

The exemplary frac site in FIG. 1 includes a relief valve system 150 configured to monitor pressure in the high pressure tubing 116 and configured to relieve system pressure in the event of over-pressurization from the pumps 112 or the wellhead 114. The relief valve system 150 is described in greater detail with reference to FIG. 2.

Figure 2:
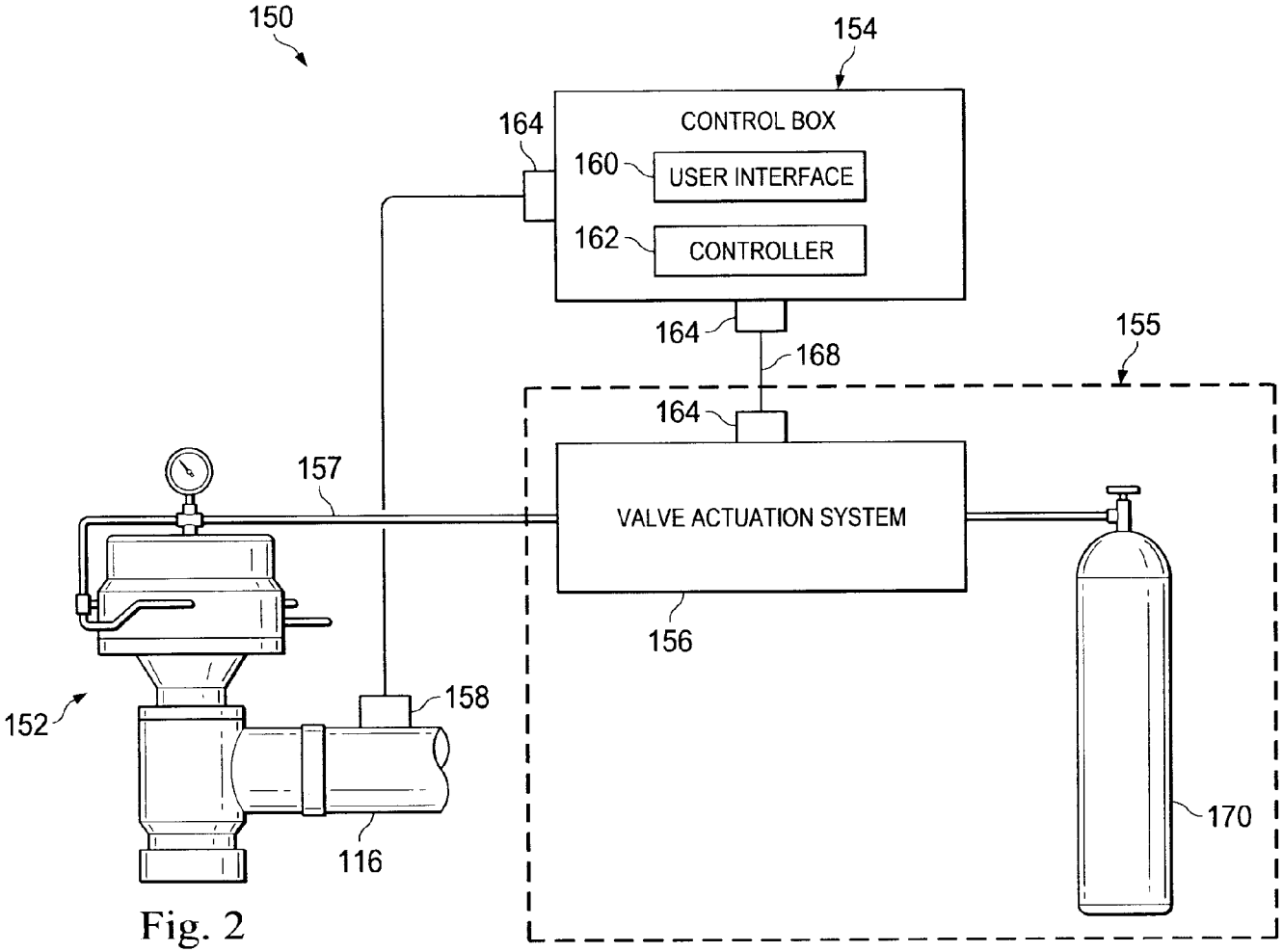
FIG. 2 is a block diagram of a relief valve system according to an exemplary aspect of the present disclosure.

FIG. 2 shows a block diagram of the relief valve system 150. It includes a relief valve 152, a control box 154, and a regulator unit 155. The regular unit 155 includes a valve actuation system 156 and an actuation fluid source 170, such as a nitrogen tank. The relief valve 152 is disposed along the high pressure tubing 116 and may relieve system pressure in the event of over-pressurization from the frac pumps 112 or the wellhead 114. As such, it may provide over-pressure protection for reciprocating pumps, treating lines, pressure vessels, and other equipment operating under high-pressure, high-flow conditions.

A pressure sensor 158 is arranged on the high pressure tubing 116 to detect pressure therethrough. In some embodiments, the pressure sensor 158 may be disposed at the inlet of the pressure relief valve 152, adjacent the pressure relief valve 152, or at other locations. The pressure sensor 158 may be any type of pressure sensor and in different embodiments may include one or more of piezoelectric sensors, capacitive sensors, electromagnetic sensors, potation sensors, thermal sensors, resonant sensors, among others. In one embodiment, it is an intrinsically safe pressure transducer. The sensor 158 may be configured to provide electronic dampening of the signal to reduce false readings due to pressure pulsations.

The control box 152 allows an operator to have direct access to data collected by the pressure sensor 158 and the valve actuation system 156. In some embodiments, the control box 154 is disposed within the data van 118 spaced apart from the pressure relief valve 152. It may be powered by any power source, and in some embodiments, is powered by 110 AC. The control box 152 may include a user interface 160 and a controller 162. In some embodiments, the user interface 160 includes a combined display and input system, such as, for example, a touch screen LCD. However, other embodiments use alternative user interfaces, including, for example, a separate display screen and a separate input system, including, for example, a keyboard, mouse, trackball, joystick, or other user input device. The user interface 160 may also include other elements including, for example, a speaker, a power switch, an emergency stop switch, and a strobe or alarm light.

The controller 162 may include a processor and memory and may be configured to detect, monitor, and control the relief valve system 150. In some embodiments the processor is an integrated circuit with power, input, and output pins capable of performing logic functions. The processor may control different components performing different functions. The memory may be a semiconductor memory that interfaces with the processor. In one example, the processor can write data and commands to and read data and commands from the memory. For example, the processor can be configured to detect, read, or receive data from the pressure sensor 158 and write that data to the memory. In this manner, a series of detected or tracked pressure readings can be stored in the memory. The processor may be also capable of performing other basic memory functions, such as erasing or overwriting the memory, detecting when the memory is full, and other common functions associated with managing semiconductor memory.

The control box 154 may also include a plurality of connectors 164 allowing connection to other components of the relief valve system 150, such as the valve actuation system 156 and the sensor 158. Although any suitable connectors may be used, one embodiment of a suitable connector includes a Circular MIL Spec 32P18 Wall mount socket connector. Other embodiments include a wireless connector comprising a transmitter and receiver that receives and transmits data to the valve actuation system 156. In one wired embodiment, the connector 164 may connect to the valve actuation system 156 using a data cable 168, such as a 150 ft weatherproof data cable. Other cable types and of course, other lengths are contemplated. The 150 ft data cable is sufficient length to extend from the valve actuation system 156 to the control box 154, which may be disposed at a different location at the frac site, such as in the data van 118.

The valve actuation system 156 is used to open and close the relief valve 152 under the control or instruction of the control box 154. It connects to the actuation fluid source 170, such as the nitrogen tank, although other fluids, including other gases or air may be used. Nitrogen from the actuation fluid source 170 provides pressurized actuation fluid that is regulated in the valve actuation system 156 to open and close the pressure relief valve 152 when pressure in the high pressure tubing 116 exceeds a pre-stored threshold. The valve actuation system 156 also connects to the relief valve 152 through a tubing referenced herein as a hose 157. Like the control box 154, the valve actuation system 156 includes a connector 164 for connecting to the cable 168 for communication between the control box 154 and the valve actuation system 156. In some embodiments, the valve actuation system 156 may receive data from the sensor 158 and may send the collected data, either before or after processing, to the control box 154.

The control box includes, in some embodiments, a backup power supply. In one embodiment, the back-up power supply is a battery. In the event of a power outage, such as an outage in the data van, the backup power supply will be enabled and will power the system.

In some embodiments, the valve actuation system 156 is a box that contains components configured to direct actuation fluid, such as the nitrogen, to the pressure relief valve 152 to open and close the valve 152. One embodiment of the valve actuation system 156 is shown in FIGS. 3-6.

Figure 3:
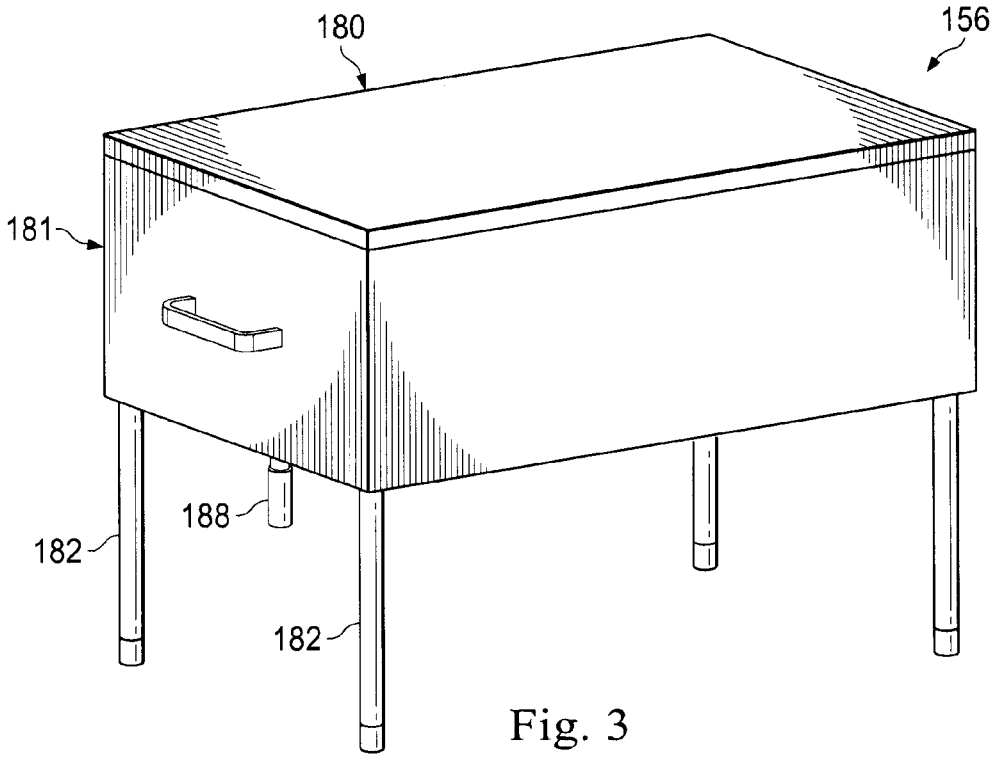
FIG. 3 is an illustration of an isometric view showing a valve actuation system according to an exemplary aspect of the present disclosure.
Figure 4:
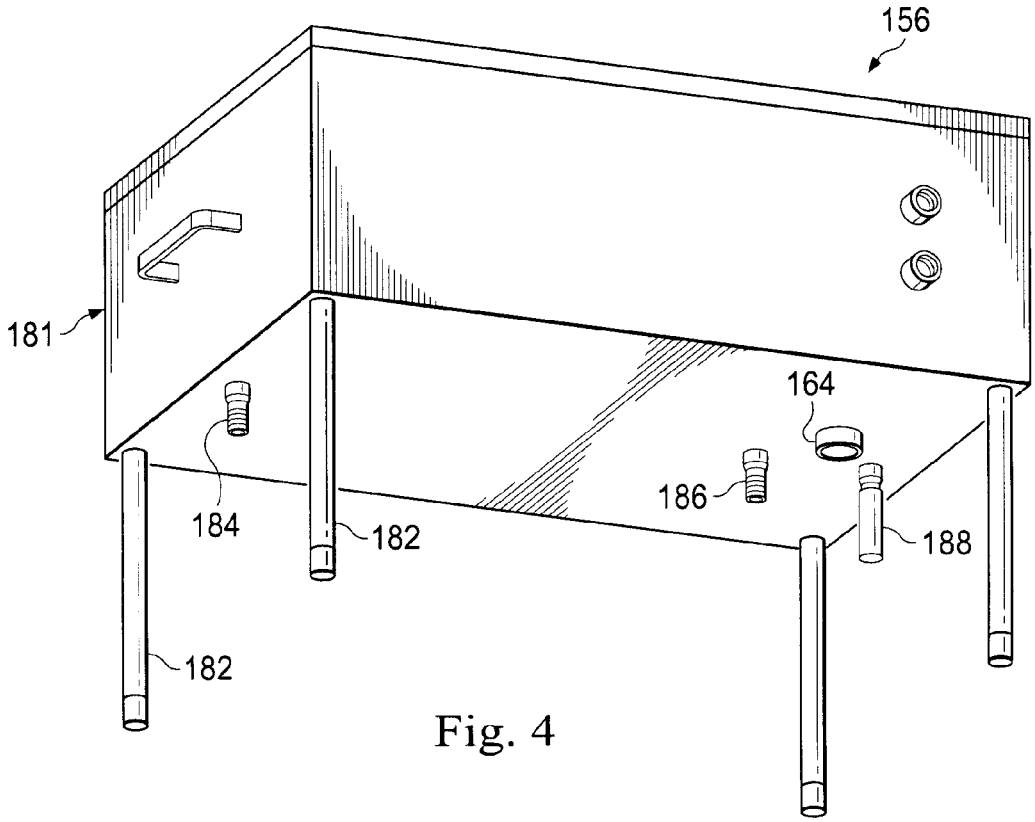
FIG. 4 is an illustration of another view showing a bottom portion of the valve actuation system of FIG. 3 according to an exemplary aspect of the present disclosure.

FIGS. 3 and 4 show different views of the valve actuation system 156 as it may be used. The valve actuation system 156 may include a housing 180 containing components that provide control of the pressure relief valve 152. In one embodiment, the housing 180 includes a main box 181 and legs 182 that maintain the components off the ground, and permit easier access to the components. In one embodiment, the legs 182 are removable. Fittings and connectors, including the connector 164 are disposed in the bottom of the main box 181. Because the fittings and connectors extend from the bottom of the main box 181, the cables, hoses, and wires are protected from kinking or bending due to gravitational forces acting on them. Accordingly, the arrangement of the connectors on the bottom allows the cables, hoses, and wires to suspend vertically from the main box 181, preventing excessive strain on the cables. In addition, at least some protection from the elements, such as rain, may also result from the arrangement.

In this example, the arrangement of connectors includes a gas inlet 184, a gas outlet 186, and a dump outlet 188. The gas inlet 186 is configured to connect to an actuation fluid source 170, such as the nitrogen tank. The gas outlet 186 connects to the relief valve 152. The dump outlet 188 is an outlet from the valve actuation system 156 to atmosphere. Therefore, in the embodiment shown, it does not require a connection.

Figure 5:
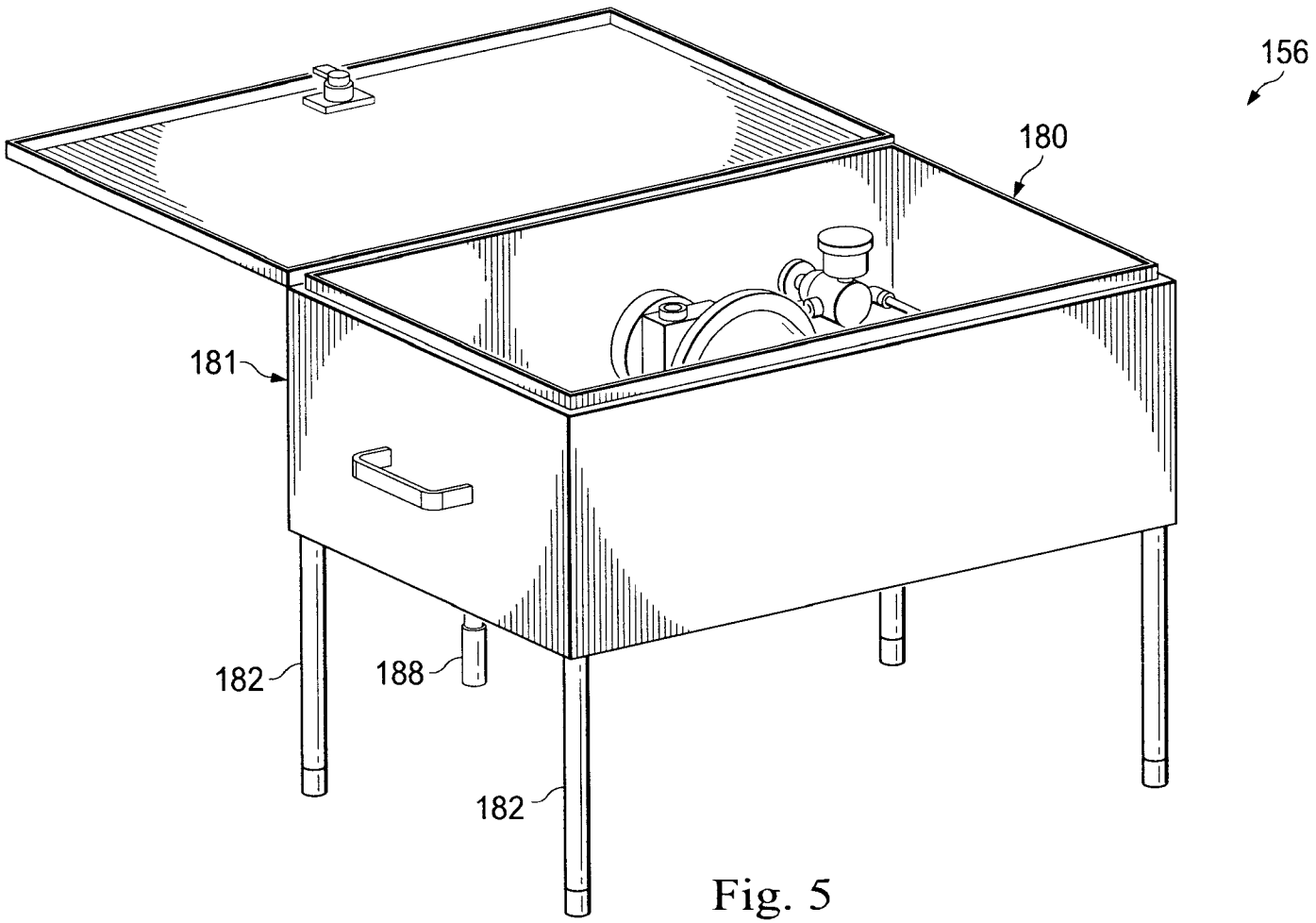
FIG. 5 is an illustration of another isometric view of the valve actuation system of FIG. 3 with a door opened according to an exemplary aspect of the present disclosure.
Figure 6:
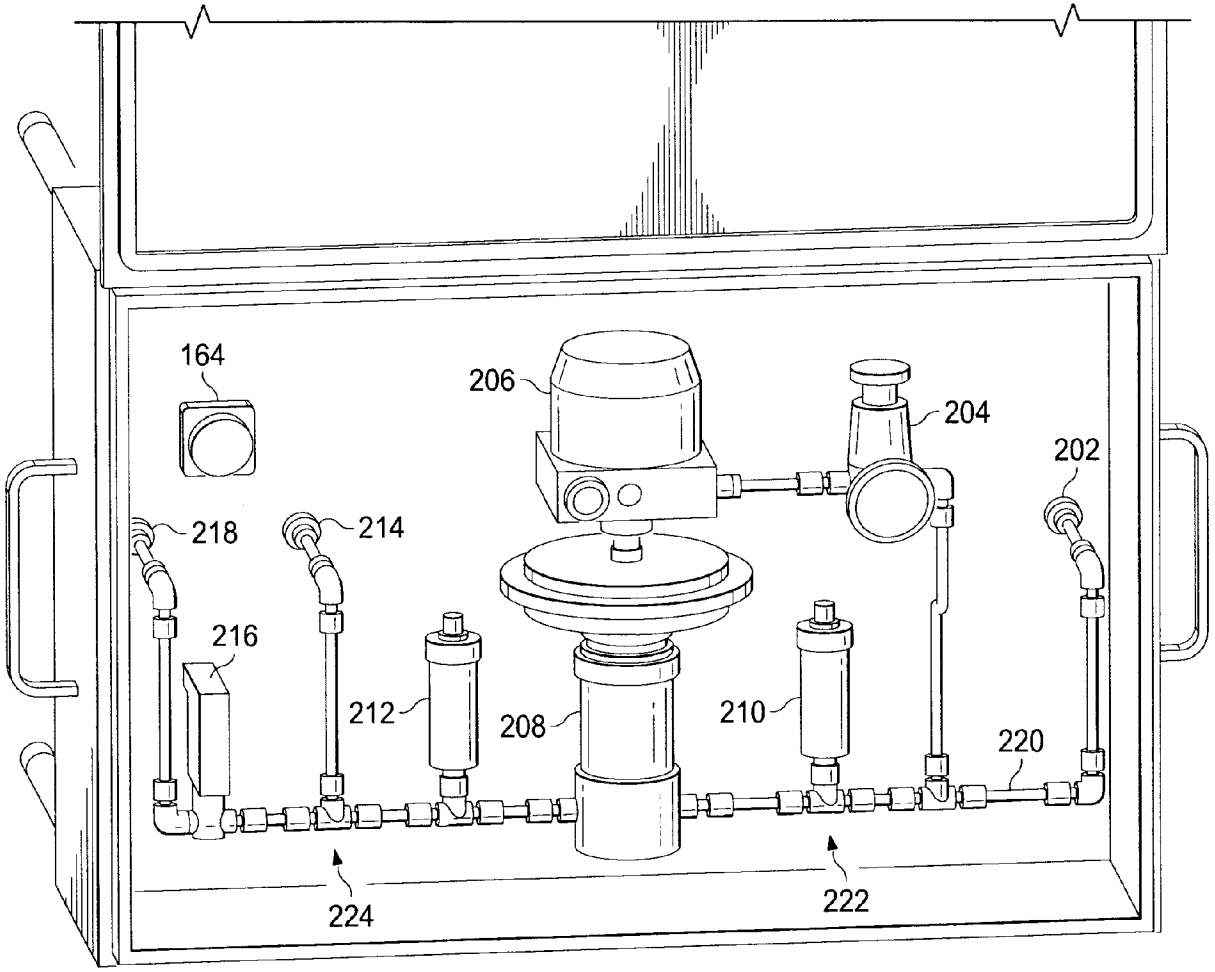
FIG. 6 is an illustration of a top view of the valve actuation system of FIG. 3 with the door opened according to an exemplary aspect of the present disclosure.
Figure 7:
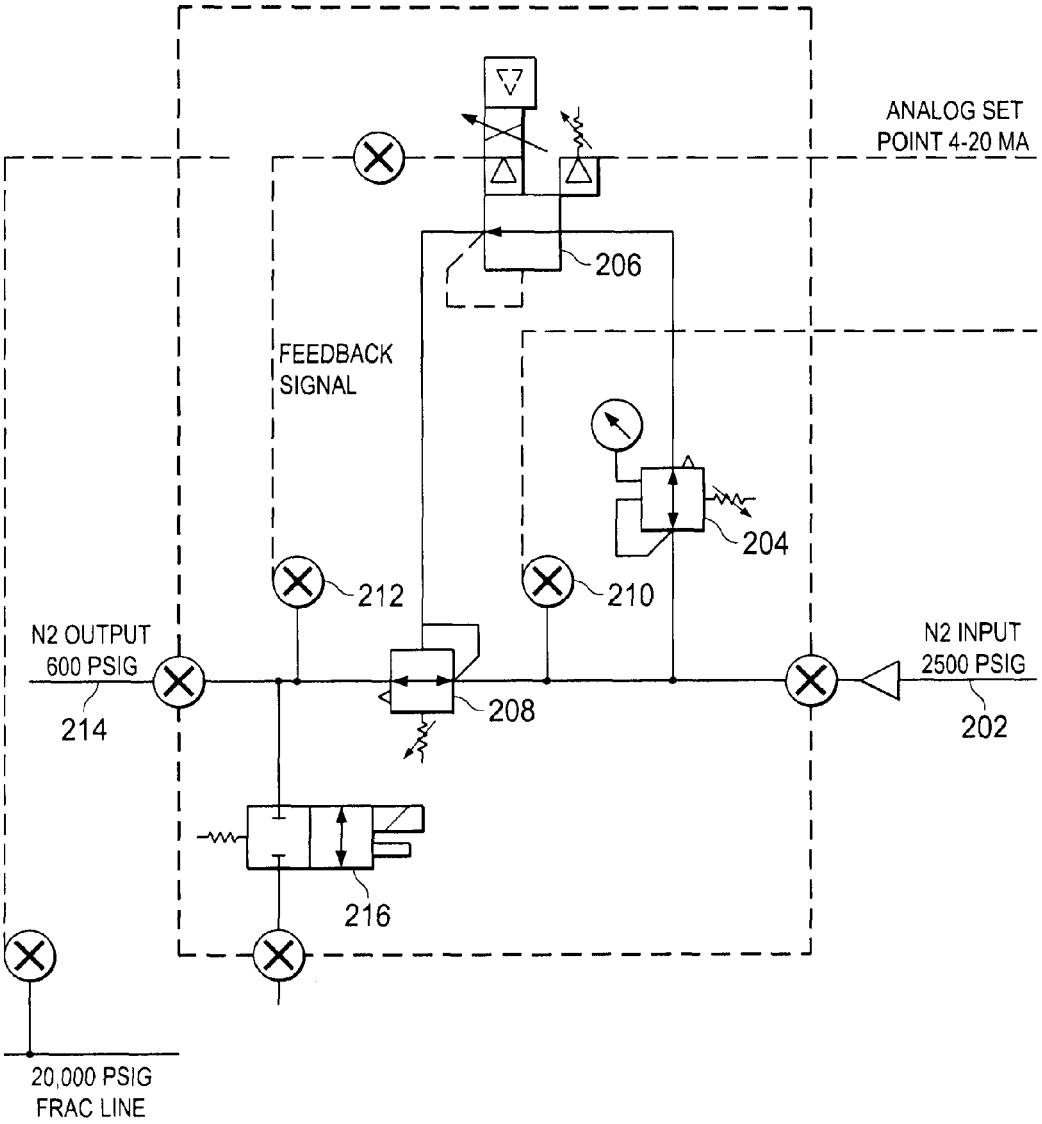
FIG. 7 is a schematic showing the hydraulic operation of components of the valve actuation system of FIG. 6 according to an exemplary aspect of the present disclosure.

FIGS. 5-7 show additional details of the valve actuation system. FIG. 5 shows that the main box 181 includes a lid that may be opened to provide access to components of the valve actuation system 156. FIG. 6 shows a view looking into the main box 181 and showing additional components of the valve actuation system 156. FIG. 7 shows a schematic of the hydraulic actuating of various components of the valve actuation system 156.

With reference to FIGS. 6 and 7, the valve actuation system 156 includes a gas input 202, an input pressure regulator 204, an electronic pressure controller 206, a main line reducing valve 208, first pressure transmitter 210, a second pressure transmitter 212, a gas output 214, a dump valve 216, a dump output 218, and the connector 164. In some embodiments, these components are intrinsically safe or explosion proof. Flow pipes 220 connect the various components as shown in FIG. 6. For purposes of explanation, the flow pipes 220 will be described as having an input portion 222 on the upstream side of the main line reducing valve 208 and an output portion 224 on the downstream side of the main line reducing valve 208.

The gas input 202 connects to the gas inlet 184 (FIG. 4) and receives pressurized gas from the actuation fluid source 170, such as the nitrogen tank. The first pressure transmitter 210 monitors the pressure of the gas in the input portion 222 of the flow tube 220. Signals representing the gas pressure are sent from the valve actuation system 156 to the control box 154 for processing and analysis.

The input pressure regulator 204 regulates gas pressure being sent to the electronic pressure controller 206. It may be set at any value and in one embodiment is configured to provide 100 psi to the electronic pressure controller 206 in order to ensure operation of the electronic pressure controller 206. Because the electronic pressure controller 206 may require voltage to maintain its settings, the gas flow to the electronic pressure controller 206 through the input pressure regulator 204 provides a continuous pressure that helps maintain the electronic pressure controller 206 in a satisfactory working condition.

The electronic pressure controller 206 is configured to control the main line reducing valve 208 depending on desired popoff values for the pressure relief valve 152. It may include logic that sets the main line reducing valve 208 to increase the efficiency of opening the pressure relief valve 152 when the relief valve popoff pressure is exceeded. This is described further below.

The main line reducing valve 208 reduces gas pressure in the flow tubes 220 from the input portion 222 of the flow tubes to the output portion 224 of the flow tubes. Accordingly, the input portion 222 may be maintained at a high pressure to assure availability of enough gas and a high enough pressure to control the relief valve 152 and the output portion 224 may be at a lower pressure that provides the actual control of the relief valve 152. In one example, the input portion 222 may be maintained at the actuation fluid source 170 pressure, which may be in the range, for example of 1500 to 2500 psig. The main line reducing valve 208 may reduce the pressure so that the outlet portion 224 of the flow tube is under about 600 psig. Other values are contemplated depending on the desired control.

The second pressure transmitter 212 monitors the pressure of the gas in the output portion 224 of the flow tube 220. Signals representing the gas pressure detected by the second pressure transmitter 212 are sent from the valve actuation system 156 to the control box 154 for processing and analysis.

The gas output 214 connects to the gas outlet 186 (FIG. 4) via the hose 157 which is connected directly to the pressure relief valve 152. Pressure in the hose 157 maintains the relief valve 152 in a closed state. The dump valve 216 is configured to open and close based on the instructions from the controller 162. As will be explained below, this will occur when pressure of the fracing fluid in the high pressure tubing 116 (FIG. 1) exceeds a preset threshold. When the dump valve 216 opens, pressurized gas in the output portion 224 of the flow tubes is released through the dump valve 216 to the dump output 218. The dump output 218 connects to the dump outlet 188 (FIG. 4) and releases gas into the air. At the same time, the sudden release of pressure in the output portion of the flow tubes 224 results in a loss of pressure at the relief valve 152, which allows the relief valve 152 to open, relieving pressure within the high pressure tubing 116. The relief valve 152 will stay open until the dump valve 216 closes, thereby allowing the output portion 224 of the flow tubes to re-pressurize. When the output portion 224 re-pressurizes, the relief valve 152 closes. The pressure valve actuation system 156 also may include an intrinsically safe surge protector, circuit breakers, and other components.

In some embodiments, the user interface 160 displays pressure information including, for example, the actuation fluid source pressure, the frac pressure, an indication of whether the relief valve is open or closed, and other information.

Figure 8:
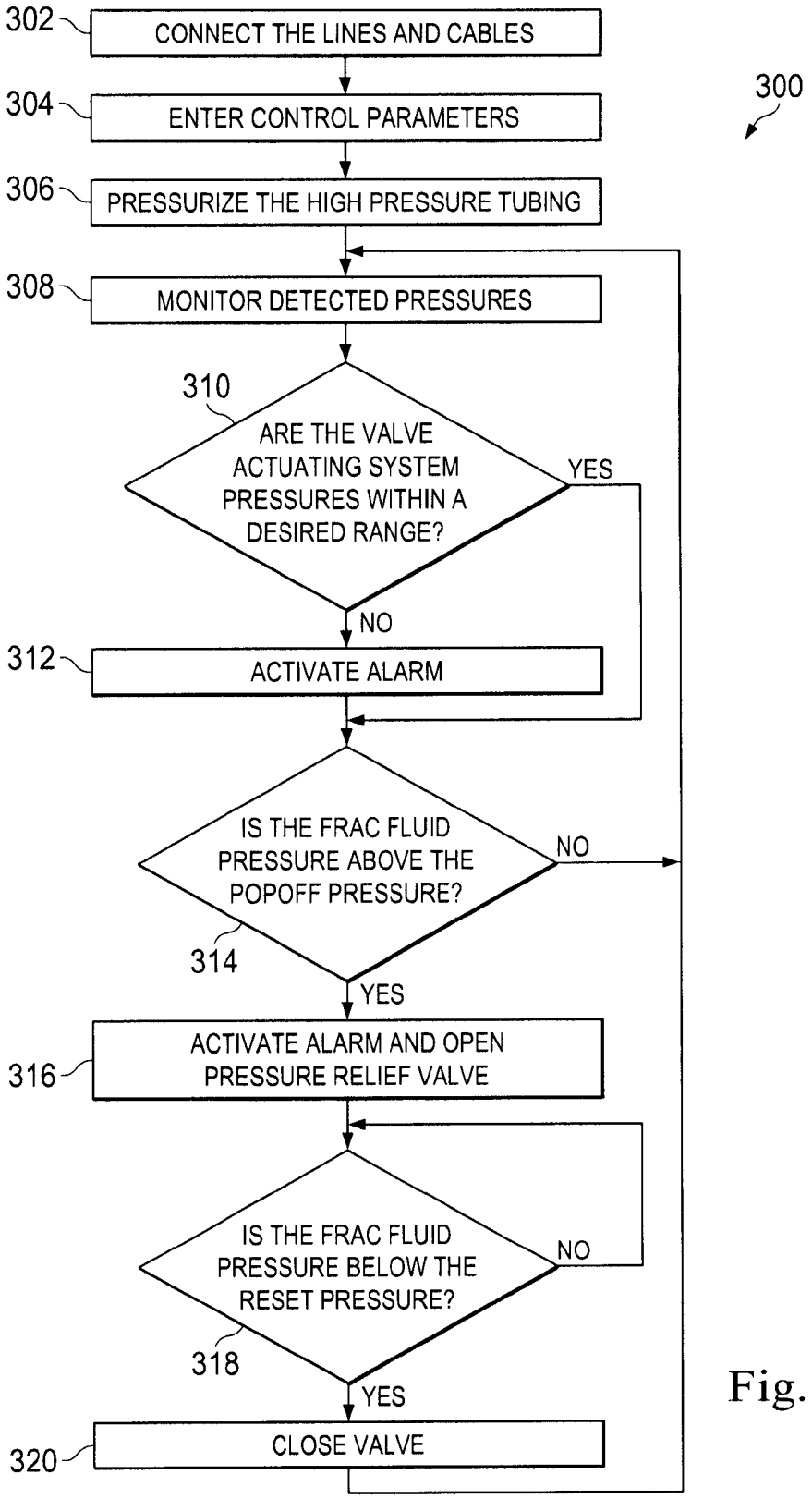
FIG. 8 is a flow chart illustrating a method of using the relief valve system in a frac site according to an exemplary embodiment of the present disclosure.

FIG. 8 is a flow chart showing an exemplary method 300 of using the relief valve system 150 as a part of the fracing equipment at the frac site 100.

The method 300 starts at a step 302 when a user connects the gas lines and cables. Connecting the gas lines includes connecting the actuation fluid source 170, such as a nitrogen tank or other pressurized gas to the relief valve system 150. As described above, this may include connecting the gas supply to the gas inlet 184. In addition, the gas outlet 186 is connected to the relief valve 152. In addition, the pressure sensor 158 is connected to the control box 154, and the valve actuation system 156 is connected to the control box 154. In some embodiments, the valve actuation system 156 is disposed in relatively close proximity to the relief valve 152 and the control box 154 is disposed elsewhere at the frac site, and in one embodiment, is disposed in the data van 118.

At a step 304, the user powers on the control box 154. Upon start up, the controller 162 may prompt an operator to enter information relating to control parameters for the relief valve 152. For example, in one embodiment, the controller 162 may prompt the user, via the user interface 160, to enter the number of relief valves that the operator wants to control with the relief valve system 150. In some embodiments, the relief valve system 150 may be used to control multiple relief valves. In one embodiment, the relief valve system 150 controls up to three relief valves. In another embodiment, the relief valve system 150 controls up to five relief valves. The relief valve system 150 may control any number of valves.

After the operator enters the number of valves to be controlled, the controller 162 may prompt the user to enter a desired popoff pressure corresponding to the desired pressure at which the relief valve will be opened. In some embodiments, this may be in the range of about 15,000 psig, although larger and smaller values may be entered.

The controller 162 may send the popoff pressure to the electronic pressure controller 206 of the valve actuation system 156. Based on the popoff pressure value, the electronic pressure controller 206 will receive its setting from the controller 162. The setting may be calculated using logic or may have tables stored therein that indicate a suitable gas pressure for the output portion 224 of the flow tubes to control the pressure relief valve 152. The electronic pressure controller 206 may then adjust the main line reducing valve 208 to provide the suitable gas pressure to the output portion 224. The suitable pressure for the output portion is a pressure that allows the pressure in the output portion 224 to quickly drop below the pressure required to open the valve 152. For example only, if the selected popoff pressure is 15,000 psi, then the pressure relief valve 152 may open when the gas pressure in the output portion 224 falls below 414 psi. The suitable pressure for the output portion 224 may then be set at, for example, at about 497 psi. For comparison, if the selected popoff pressure is 1,000 psi, then the pressure relief valve 152 may open when the gas pressure in the output portion 224 falls below 28 psi. The suitable pressure for the output portion 224 may then be set at, for example, at about 34 psi. Setting the pressure for the output portion 224 too high might result in an overly long delay between the time the dump valve 216 opens and the time the relief valve 152 opens. Setting the pressure for the output portion 224 only slightly above the pressure that opens the relief valve 152 ensures a high level of responsiveness because only a small pressure shift is needed to permit the relief valve to move from a closed state to an open state.

In some embodiments, the electronic pressure controller 206 may adjust the main line reducing valve 208 to provide a pressure within the output portion 224 of about 105-150% of the gas pressure threshold that opens the relief valve 152. In other embodiments, the range is about 101-200% of the gas pressure threshold that opens the relief valve 152. In one embodiment, the suitable pressure is about 120% of the gas pressure threshold that opens the relief valve 152. Other values are contemplated. Other embodiments do not employ the electronic pressure controller 206 and always use the same gas pressure in the output portion 224 regardless of the setting of the popoff pressure.

The controller 162 may then prompt the operator to enter time increments in which the system pressure will be monitored before it opens the valve 152. In some examples, this may selected to be in the range between about 0.001 to 3 seconds. In some other embodiments, the time increment may be selected within the range of about 0.1 to 1 second. Other ranges are still contemplated, including, for example, only a range about 4-10 seconds. Yet other increment values are contemplated, including shorter and longer increments depending on the desire of the operator. In some embodiments, the increment is selected to be minimal so that the valve 152 responds nearly instantaneously when pressures exceed the set popoff pressure.

During use, the control box 154 may receive data regarding the instantaneous pressure within the high pressure tubing 116 from the pressure sensor 158. Since the pressure may fluctuate rapidly or may have pressure spikes, the instantaneous pressure may seem volatile while not exposing any components of the fracing system to failure loading. In addition, the pressure sensor signals themselves may have some noise affecting accuracy of the sensor reading. According, in order to avoid opening the valve whenever a small spike or signal noise indicates that the pressure exceeded the set popoff pressure, the control box 154 may be programmed to determine an average pressure taken over an increment of time. For example, a small pressure spike might momentarily exceed the popoff pressure, but the average pressure over a three second increment may be below the popoff pressure. In such an instance, the control box 154 may be programmed to not take action to open the pressure relief valve 152, but the fracing process may continue uninterrupted. However, if the average pressure over the same increment exceeds the popoff pressure, the control box 154 may generate a control signal to open the pressure relief valve 152. This provides many advantages over a system that does not use electronic control of its pressure relief valve because it may reduce the incidence of valve chatter as the valve responds to pressure spikes. This in turn may increase reliability, reduce wear, and increase the overall robustness of the system.

The control box 154 may then prompt the user to enter a reset pressure. A reset pressure is the pressure at which the valve 152 will be closed. In one embodiment, the popoff pressure is 1500 psig and the reset pressure is 1450 psig. Accordingly, the relief valve 152 may open at 1500 psig and may close when the pressure drops below 1450 psig. In other embodiments, the reset pressure is set at or near 0 psig. In such embodiments, the relief valve 152 will not reset until substantially all pressure is removed from the system. The reset pressure may be set at any value between the popoff pressure and zero, as desired. In one aspect, the controller is programmed to not allow a reset pressure to be entered that is higher than the popoff pressure.

At step 306, the operator may pressurize the high pressure tubing 116. This may include powering up the fracing equipment, including the blender 108 and the high pressure frac pumps 112. As pressure begins to mount in the high pressure tubing 116, the relief valve system 150 may monitor detected settings, as indicated at step 308.

Monitoring detected pressures may include monitoring the pressure in the high pressure tubing 116 with the pressure sensor 158 and receiving data indicative of the pressure in the high pressure tubing. It also may include monitoring the gas pressure in the input portion 222 of the flow tubes in the valve actuation system 156. This pressure may be monitored because a decrease in pressure at the input portion 222 of the flow tubes may influence the ability of the valve actuation system 150 to actuate the relief valve 152. Accordingly, in one embodiment, the pressure detected by the first pressure transmitter 210 may be compared to a stored pressure threshold to determine whether the pressure is at a satisfactory level. In one example, the pressure threshold is set at 1000 psig. However, other threshold values are contemplated, both higher and lower.

The control box 154 also may include monitoring the gas pressure in the output portion 224 of the flow tubes in the valve actuation system 156. This pressure may be monitored because, like the input portion 222 discussed above, a decrease in pressure at the output portion 224 of the flow tubes may influence the ability of the valve actuation system 150 to actuate the relief valve 152. Accordingly the pressure detected by the second pressure transmitter 212 may be compared to a stored pressure threshold to determine whether the pressure is at a satisfactory level. In one example, the pressure threshold for the output portion 224 of the flow tubes is set at 600 psig. However, other threshold values are contemplated, both higher and lower, and this may adjust with changes to the main line reducing valve 208.

At a step 310, the control box 154 may determine whether the detected pressures of the valve actuation system 156 (including one or both of the first and second pressure transmitters 210, 212) are above the preset pressure thresholds. If one or both is below the preset pressure thresholds, the control box 154 may alert the operator by activating an alarm, at a step 312. It may send a visual alert to the user interface 160, such as a red warning beacon at a display screen or a flashing strobe light, may activate an audible alert such as a buzzer or sound through the speaker of the user interface, or other alert, such as a tactile alert. In some embodiments, it may take action by controlling the frac site to reduce pump pressures, or may take other action until the pressures are restored to values above the thresholds. If the pressure transmitter 210 sends a signal to the controller 162 that is below the 1000 psi minimum required nitrogen pressure, the controller will activate the alarm until the nitrogen bottle is replaced with another bottle. If pressure transmitter 212 sends a signal that doesn't match the corresponding nitrogen pressure/system pressure setting, the controller will re-check the inputted popoff pressure and send the signal to the electronic pressure controller. This will only occur if the pressure sensor 158 does not read an overpressure. In some embodiments, the alarm will continue until an operator enters an acknowledgement at the user interface 160. In some aspects, the system also activates an alarm if the controller 162 is not receiving a signal from the pressure transducer. This may be an indication that the transducer or the data cable is not properly connected. An alarm also may be activated if main power is lost. In one aspect when power is lost, the user may acknowledge the alarm at the user interface 160, and the system 150 will continue to operate using back-up power. 3

At a step 314, the control box 154 also may detect whether the fracing fluid pressure in the high pressure tubing 116 is below the popoff pressure. This may include receiving data from the pressure sensor 158 and comparing the average pressure over a time increment or comparing instantaneous measured pressure within the high pressure tubing 116 to the preset popoff pressure. At a step 316, if the fracing fluid pressure is over the desired popoff pressure, then the control box 154 may activate an alarm and open the pressure relief valve at a step 316. The alarm may be a visual, audible, or other alarm as discussed above. The system 150 may open the pressure relief valve 152 by sending a control signal from the controller 162 to the dump valve 216. The dump valve 216 may open, thereby releasing the gas pressure in the output portion 224 of the flow tubes, allowing the relief valve 152 to open. This of course releases pressure in the high pressure tubing 116.

At a step 318, the pressure sensor 158 continues to monitor pressure in the high pressure tubing 116. When the pressure reaches or drops below the reset threshold, the control box 154 closes the dump valve 216. As such, pressure again builds within the output portion 224 of the flow tubes, which then ultimately closes the pressure relief valve 152, as indicated at a step 320.

Figure 9:
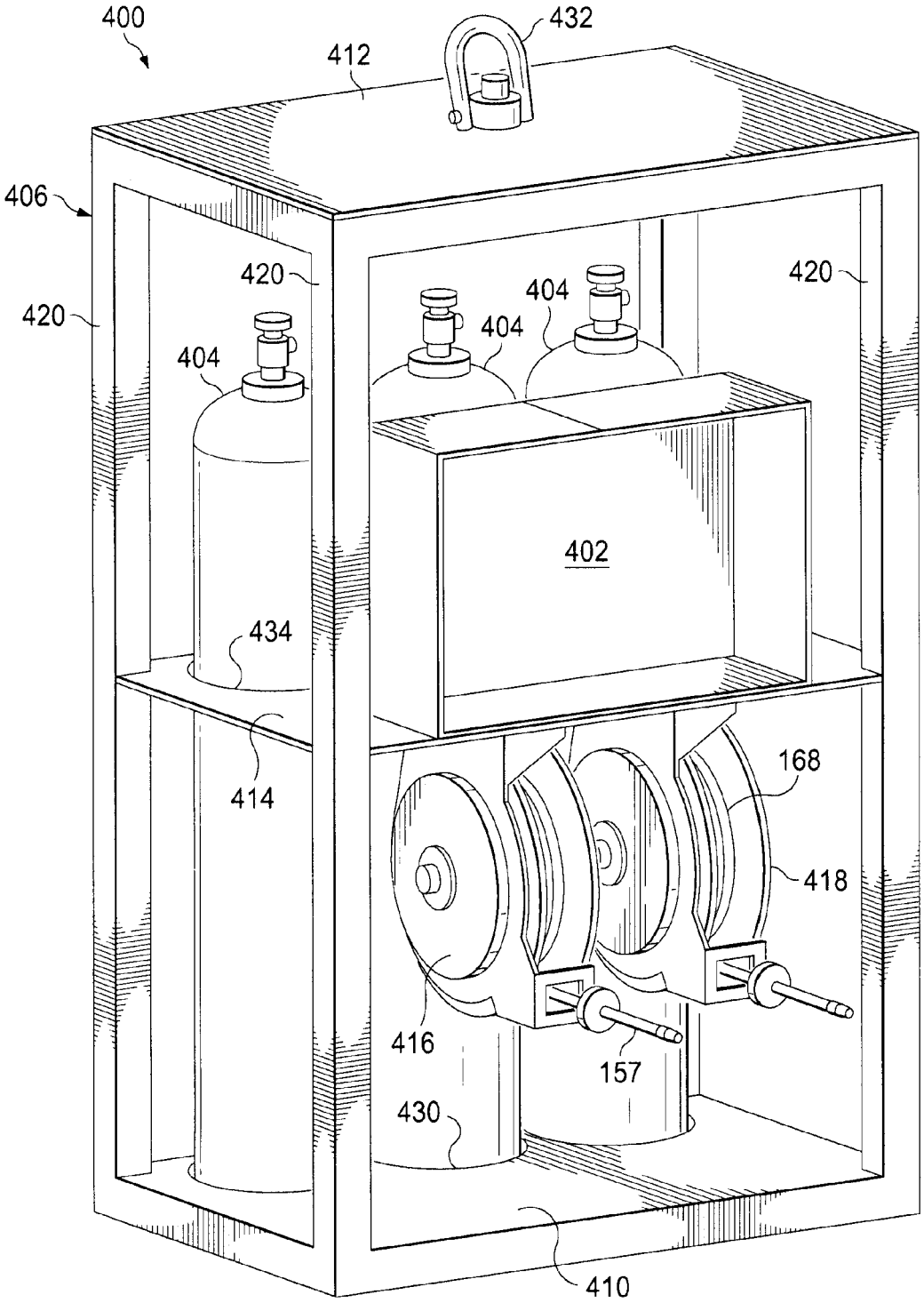
FIG. 9 is an illustration of an isometric view of exemplary regulator unit of relief valve system according to an exemplary aspect of the present disclosure.

FIG. 9 illustrates an alternative regulator unit 400 that may be used to communicate with the control box 154 and operate the pressure release valve 152. In some aspects, the regulator unit 400 may be used to replace the regulator unit 155 shown in FIG. 2.

In this embodiment, the regulator unit 400 includes a valve actuation system 402, an actuation fluid source 404, and a regulator structure 406 that supports the valve actuation system 402 and the actuation fluid source 404.

The actuation fluid source 404 may be the same as the actuation fluid source 170 described above. Accordingly, in some embodiments, the actuation fluid source 404 is one or more fluid tanks, such as nitrogen gas tanks, that may be used to supply actuation fluid to the valve actuation system 402. As can be seen in FIG. 9, the actuation fluid source 404 may include a plurality of gas tanks that together cooperate to form the actuation fluid source 404. Accordingly, the description of the actuation fluid source 170 applies equally to the actuation fluid source 404.

The valve actuation system 402 is formed of the main box 181 of the valve actuation system 156 described herein, and may include the same regulating components and elements described and shown with reference to the valve actuation system 156. Accordingly, the description of the above of the main box 181 and the operation and function of the components applies equally to the valve actuation system 402.

The regulator structure 406 joins the valve actuation system 402 and the fluid source 404 into a single transportable unit providing ease of transportation, simple organization, and convenience to frac operators. This all contributes to a more organized frac site and greater protection for the valve actuation system 402 and the actuation fluid source 404.

In the embodiment disclosed, the regulator structure 406 is a skid that may be lifted, carried, and moved to a desired position in the frac site. It may be lifted to or removed from a transportation vehicle using a forklift or crane for example, although other methods may be used. In some embodiments, it may be maintained operated while disposed on a truck or other vehicle parked at the frac site.

The regulator structure 406 in this exemplary embodiment includes a lower platform or base 410, a top structure 412, an intermediate support structure 414, a hose reel 416, and a data cable reel 418. Struts or beams 420 connect the base 410, the top structure 412, and the support structure 414 and provide rigidity to the regulator structure 406.

In the exemplary embodiment shown, the base 410 is arranged to support or stabilize the actuation fluid source 404. In this example, in order to render the regulator structure 406 fully transportable, the base 410 includes stabilizing features 430 formed to receive the actuation fluid source 404 and that maintain the actuation fluid source 404 within the regulator structure 406. In this embodiment, where the actuation fluid source 404 is one or more nitrogen gas tanks, the stabilizing features 430 are recesses or cutouts formed in a portion of the base 410 that receive the ends of the gas tanks. Accordingly, even during transportation, the fluid actuation source 404 may be easily maintained in a relatively secure condition.

The top structure 412 in this embodiment is a roof portion that may cover at least a portion of the valve actuation system 402 and the actuation fluid source 404. In the embodiment shown, the top structure 412 is a flat plate and includes a connector portion 432 configured to aid in transportation of the regulator unit 400. In the example shown, the connector portion 432 is a ring arranged to receive a hook (not shown), such as a crane hook enabling the regulator structure 406 (and the entire regulator unit 400) to be connected moved about the frac site or onto or off of a transportation vehicle. Alternative connector portions include chains, hooks, cut-outs, hangers, or other connectors.

The support structure 414 in this embodiment connects to the struts 420 and may serve as a shelf that may be used for the placement of tools and equipment when servicing the valve actuation system 402 and the actuation fluid source 404. In addition, the support structure 414 includes fluid-source stabilizing features 434, shown in FIG. 9 as cut-outs that receive the tanks forming the actuation fluid source 404. The embodiment shown includes three independent stabilizing features 434 that support three separate fluid tanks. Accordingly even during transportation, the tanks forming the actuating fluid source 404 are separated and maintained in an upright position. In this embodiment, there are three tanks, however, other embodiments have one, two, or more than three tanks as an actuation fluid source 404.

In the embodiment shown, the valve actuation system 402 is disposed on the support structure 414. Accordingly, the components of the valve actuation system 402 are disposed at a height providing convenient access to a frac operator. As such, the frac operator has easy access to, for example, the input pressure regulator 204, the electronic pressure controller 206, the main line reducing valve 208, the first and second pressure transmitters 210, 212, and other components forming a part of the valve actuation system 402.

In the exemplary embodiment shown, the hose reel 416 is suspended from the intermediate support structure 414 and winds the hose 157 used to place the actuation fluid source 404 in fluid communication with the relief valve 152 (FIG. 2). In some embodiments, the hose reel 416 is a spring loaded reel that allows a user to unroll the hose 157 by pulling on an end, and may automatically retract and roll the hose 157 onto the regulator structure 406. This may provide convenience and efficiency to the operator.

In the exemplary embodiment shown, the data cable reel 418 is disposed adjacent the hose reel 416 and also suspended from the intermediate support structure 414. The data cable reel 418 carries the data cable 168 that extends between and connects in electrical communication the valve actuation system 402 and the control box 154. The data cable 168 may be unrolled by pulling on a cable end and connecting it to the control box 154, either directly or indirectly. In some embodiments where the control box 154 is disposed in the data van 118, the data cable 168 may extend to a connector on the data van 118 and may connect through the connector on the data van 118. Like the hose reel 416, the data cable reel 418 may be spring loaded to automatically roll the data cable 168 when desired. When wireless systems are used, naturally the data cable 168 and the data cable reel 418 may be replaced with a transmitter and receiver.

In some embodiments, both the hose 157 and the data cable 168 include quick-disconnect connectors that simply and quickly connect and disconnect to the pressure relief valve 152 and the control box 154, respectively. Other embodiments include twist connectors, snap-on connectors and other connectors including the connectors discussed with reference to the valve actuation system 156 discussed previously.

The hose reel 416 and the data cable reel 418 simplify setup and site takedown and may help reduce hose or cable clutter about the frac site. A frac site may include any number of cables and hoses extending between and connecting the data truck 118 to other trucks, trailers, or equipment pieces disposed about the frac site. Accordingly, a large number of hoses and cables may lie all about the frac site. By rolling excess hose and cable lengths onto the hose and data cable reels 416, 418, the frac site may be maintained in a more organized condition.

While only one support structure 414 is shown in FIG. 9, other embodiments have multiple support structures that may be used as shelves, storage boxes, or for other utility purposes. In one embodiment, a second support structure 414 is disposed below the hose reel 416 and the data cable reel 418.

Some embodiments of the regulator structure 406 include fork-receiving structures at the base 410 that receive forks of a fork lift. In some of these embodiments, the fork-receiving structures are enclosed in order to reduce the likelihood of the regulator structure 406 tipping off the forks during transportation to or from an operating location at the frac site.

In some embodiments the regulator structure 406 is enclosed by walls that more completely protect the valve actuation system 402 and the actuation fluid source 404 from the outside environment, including, among other things, harsh or damaging weather, dust, and direct sunlight. In some embodiments, the walls are formed by solid metal material, while in other embodiments, the walls are formed of a metal mesh. Yet other embodiments have walls formed of flexible material, such as canvas material or tarpaulin. Any suitable material may be used. In some embodiments, only a portion of the regulator structure 406 is enclosed, while other parts are open to the environment.

Although shown in FIG. 9 as carrying only the valve actuation system 402 and the actuation fluid source 406, some embodiments of the regulator structure 406 also carry components of the control box 154. For example, in some embodiment, the controller 162 (FIG. 2) is disposed on the regulator structure 406, while the user interface 160 is disposed apart from the controller, such as on the data van 118. In one embodiment, the user interface 160 may be disposed in the data van 118 providing an operator with access to, for example, the display and input system, the speaker, the power switch, the emergency stop switch, and the strobe or alarm light. The data cable 168 on the regulator structure 406 and on the data cable reel 418 may then extend from the controller 162 on the regulator structure 406 to the user interface 160. In yet other embodiments, the controller 162 and user interface 160 are separate from each other, while neither is carried on the regulator structure 406. For example, the controller 162 may be disposed in a control box outside the data truck 118, the user interface 160 may be disposed inside the data truck 118, and the data cable may extend between the controller and the regulator structure 406. An additional data cable may extend between the user interface 160 and the controller 162.

In one embodiment, the controller 162 is configured in a manner to detect when the relief valve 152 is not operational, such as during the frac site setup. In this condition, the controller 162 may disable the alarm function to reduce the likelihood of false alarms. The alarm system may then become operational only after the relief valve system 150 is properly setup and powered. In some aspects, the controller 162 detects the lack of a pressure signal or a pressure transducer signal to disable the alarm during setup. In this embodiment, powering the system or otherwise turning on or making the alarm operational is a part of a setup procedure for the relief valve system.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, invention(s) have described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

We claim:

1. A pressure relief valve system for use in a downhole operation, the pressure relief valve system comprising:

a pressure relief valve configured to relieve pressure from high pressure tubing extending between a pump and a wellhead;

a sensor operably disposed to detect pressure in the high pressure tubing;

a controller having a pressure threshold stored therein, the controller being configured to receive data from the sensor and compare the detected pressure to the stored pressure threshold;

a gas source to provide a pressurized gas at a first gas pressure; and a valve actuation system in communication with the gas source, in communication with the pressure relief valve, and in communication with the controller, the valve actuation system being configured to change the state of the pressure relief valve from a closed state to an open state in response to a command signal from the controller, the valve actuation system comprising an output portion connected to the pressure relief valve and containing the pressurized gas at a second gas pressure; wherein the second gas pressure of the pressurized gas contained in the output portion maintains the pressure relief valve in the closed state; and wherein the second gas pressure of the pressurized gas contained in the output portion is less than the first gas pressure of the pressurized gas.

2. The pressure relief valve system of claim 1, wherein the controller is configured to emit the command signal when the controller determines that the detected pressure exceeds the stored pressure threshold.

3. The pressure relief valve system of claim 1, wherein the valve actuation system comprises a dump valve that receives the command signal from the controller.

4. The pressure relief valve system of claim 1, wherein the valve actuation system further comprises:

an input portion connected to the gas source and containing the pressurized gas at a third gas pressure; and a reducing valve disposed between the input portion and the output portion, the reducing valve being configured to adjust the second gas pressure of the pressurized gas contained in the output portion based on data from the controller.

5. The pressure relief valve system of claim 4, further comprising: a first pressure transmitter configured to detect the third gas pressure of the pressurized gas contained in the input portion; and a second pressure transmitter configured to detect the second gas pressure of the pressurized gas contained in the output portion.

6. The pressure relief valve system of claim 5, wherein the third gas pressure is equal to the first gas pressure.

7. The pressure relief valve system of claim 4, wherein the third gas pressure is equal to the first gas pressure.

8. The pressure relief valve system of claim 1, wherein the controller is configured to receive an operator input that sets said pressure threshold, the controller also being configured to receive an operator input that sets a reset pressure for the pressure relief valve.

9. The pressure relief valve system of claim 1, wherein the controller is operable via a touch screen interface.

10. The pressure relief valve system of claim 1, wherein the controller is configured to average the detected pressure over an increment of time and compare the average detected pressure to the stored pressure threshold.

11. The pressure relief valve system of claim 1, wherein the controller receives data directly from the sensor.

12. The pressure relief valve system of claim 1, wherein the gas source comprises a nitrogen tank.

13. The pressure relief valve system of claim 1, wherein, when the pressure relief valve is in the closed state, the second gas pressure is about 105-150% of a gas pressure threshold that opens the pressure relief valve.

14. A pressure relief valve system for use in a downhole operation, the pressure relief valve system comprising:

a pressure relief valve configured to relieve pressure from high pressure tubing extending between a pump and a wellhead;

a sensor operably disposed to detect pressure in the high pressure tubing;

a controller having a pressure threshold stored therein, the controller being configured to receive data from the sensor and compare the detected pressure to the stored pressure threshold;

a valve actuation system in communication with the pressure relief valve, and in communication with the controller, the valve actuation system being configured to change the state of the pressure relief valve from a closed state to an open state in response to a command signal from the controller;

wherein the valve actuation system comprises:

an input portion connected to a gas source;

an output portion connected to the pressure relief valve; and a reducing valve disposed between the input portion and the output portion, the reducing valve being configured to adjust the pressure in the output portion based on data from the controller;

and wherein the valve actuation system comprises a second controller configured to determine a suitable pressure for the output portion, the second controller configured to adjust the reducing valve to achieve the suitable pressure in the output portion.

15. The pressure relief valve system of claim 14, wherein the suitable pressure is about 105-150% of a gas pressure threshold that opens the relief valve.

16. A pressure relief valve system for use in a downhole operation, comprising:

a pressure relief valve configured to relieve pressure from high pressure tubing extending between a pump and a wellhead;

a sensor operably disposed to detect pressure in the high pressure tubing;

a controller having a pressure threshold stored therein, the controller being configured to receive data from the sensor and compare the detected pressure to the stored pressure threshold;

a valve actuation system in communication with the pressure relief valve, and in communication with the controller, the valve actuation system being configured to change the state of the pressure relief valve from a closed state to an open state in response to a command signal from the controller;

an actuation fluid source in communication with the valve actuation system, the actuation fluid source providing fluid pressurized to maintain the state of the pressure relief valve in a closed state; and a regulator structure carrying the valve actuation system and the actuation fluid source in a single transportable unit.

17. The pressure relief valve system of claim 16, wherein the regulator structure is a skid.

18. The pressure relief valve system of claim 16, wherein the regulator structure comprises:

a hose reel carrying a hose extendable between the valve actuation system and the pressure relief valve and configured to place the valve actuation system and the pressure relief valve in fluid communication; and a data cable reel carrying a data cable extendable between the valve actuation system and the controller and configured to place the valve actuation system and the controller in electrical communication.

19. The pressure relief valve system of claim 16, further comprising a user interface in communication with the controller, wherein the regulator structure carries the controller and comprises:

a hose reel carrying a hose extendable between the valve actuation system and the pressure relief valve and configured to place the valve actuation system and the pressure relief valve in fluid communication; and a data cable reel carrying a data cable extendable between the controller and the user interface and configured to place the controller and the user interface in electrical communication.

20. A method of controlling a pressure relief valve in a downhole operation, the method comprising:

maintaining a pressure relief valve in a closed state with a pressurized gas, comprising:

receiving the pressurized gas at a first gas pressure; and reducing the pressure of the pressurized gas from the first gas pressure to a second gas pressure that is less than the first gas pressure;

wherein the second gas pressure of the pressurized gas maintains the pressure relief valve in the closed state;

detecting, with a pressure sensor disposed adjacent the pressure relief valve, a fluid pressure in a high pressure tube extending between a pump and a wellhead;

comparing the detected pressure to a stored fluid pressure threshold;

sending a signal to open a dump valve if the detected pressure exceeds the fluid pressure threshold; and opening the dump valve to lower the second gas pressure of the pressurized gas until the pressure relief valve changes from the closed state to the open state.

21. The method of claim 20, comprising:

regulating, using a reducing valve, the second gas pressure of the pressurized gas that maintains the pressure relief valve in the closed state; and controlling the reducing valve with an electronic controller.

22. The method of claim 21, wherein regulating the second gas pressure of the pressurized gas comprises maintaining the second gas pressure at a pressure about 105-150% of a gas pressure threshold that opens the pressure relief valve.

23. The method of claim 22, comprising changing the second gas pressure of the pressurized gas with the reducing valve in response to changes in the gas pressure threshold.

24. The method of claim 20, wherein, when the pressure relief valve is in the closed state, the second gas pressure is about 105-150% of a gas pressure threshold that opens the pressure relief valve.

25. A method of controlling a pressure relief valve in a downhole operation, the method comprising:

maintaining a pressure relief valve in a closed state with a pressurized gas;

detecting, with a pressure sensor disposed adjacent the pressure relief valve, a fluid pressure in a high pressure tube extending between a pump and a wellhead;

comparing the detected pressure to a stored fluid pressure threshold;

sending a signal to open a dump valve if the detected pressure exceeds the fluid pressure threshold;

opening the dump valve to lower the pressure of the pressurized gas until the pressure relief valve changes from the closed state to the open state;

prompting an operator to enter the fluid pressure threshold;

prompting an operator to enter a reset pressure threshold; and closing the dump valve to increase the pressure of the pressurized gas when the detected fluid pressure is below the reset pressure threshold.

26. A method of controlling a pressure relief valve in a downhole operation, the method comprising:

maintaining a pressure relief valve in a closed state with a pressurized gas;

detecting, with a pressure sensor disposed adjacent the pressure relief valve, a fluid pressure in a high pressure tube extending between a pump and a wellhead;

comparing the detected pressure to a stored fluid pressure threshold;

sending a signal to open a dump valve if the detected pressure exceeds the fluid pressure threshold; and opening the dump valve to lower the pressure of the pressurized gas until the pressure relief valve changes from the closed state to the open state;

wherein detecting the pressure of fluid comprises:

averaging the pressure over an increment of time to obtain the average pressure, and wherein comparing the detected pressure to a fluid pressure threshold comprises comparing the average pressure to the fluid pressure threshold.

27. A pressure relief valve system for a high pressure frac tubing, the pressure relief valve system comprising:

a pressure relief valve configured to relieve pressure from the high pressure frac tubing extending between a frac pump and a wellhead;

a sensor operably disposed to detect pressure in the high pressure frac tubing;

a controller configured to receive a desired pressure threshold, configured to receive data from the sensor representing a detected pressure, and configured to compare the detected pressure to the desired pressure threshold;

a valve actuation system in communication with the pressure relief valve and in communication with the controller, the valve actuation system being configured to change the state of the pressure relief valve from a closed state to an open state in response to a command signal from the controller; and an actuation fluid source in fluid communication with the valve actuation system and configured to supply pressurized fluid to the valve actuation system at a first fluid pressure;

wherein the valve actuation system is configured to reduce the pressure of the pressurized fluid from the first fluid pressure to a second fluid pressure that is less than the first fluid pressure; and wherein the second fluid pressure of the pressurized fluid maintains the pressure relief valve in the closed state.

28. The pressure relief valve system of claim 27, wherein the valve actuation system is disposed adjacent the pressure relief valve.

29. The pressure relief valve system of claim 27, wherein the valve actuation system comprises:

an input portion connected to the actuation fluid source;

an output portion connected to the pressure relief valve; and a reducing valve disposed between the input portion and the output portion, the reducing valve being configured to adjust the pressure in the output portion based on data from the controller.

30. The pressure relief valve system of claim 29, wherein the actuation fluid source is a gas source;

wherein the pressurized fluid is a pressurized gas;

wherein the first and second fluid pressures are first and second gas pressures, respectively, of the pressurized gas;

wherein the output portion contains the pressurized gas at the second gas pressure;

wherein the reducing valve is configured to adjust the second gas pressure based on the data from the controller; and wherein the input portion contains the pressurized gas at a third gas pressure.

31. The pressure relief valve system of claim 30, wherein the third gas pressure is equal to the first gas pressure.

32. The pressure relief valve system of claim 27, further comprising a user interface configured to receive operator inputs representing the desired pressure threshold from an operator.

33. The pressure relief valve system of claim 32, further comprising a control van, the user interface being disposed in the control van and the valve actuation system being disposed adjacent the pressure relief valve.

34. The pressure relief valve system of claim 27, wherein the actuation fluid source is a gas source.

35. The pressure relief valve system of claim 34, wherein the gas source comprises a nitrogen tank.

36. The pressure relief valve system of claim 27, wherein, when the pressure relief valve is in the closed state, the second fluid pressure is about 105-150% of a fluid pressure threshold that opens the pressure relief valve.

37. A pressure relief valve system for a high pressure frac tubing, the pressure relief valve system comprising:

a pressure relief valve configured to relieve pressure from the high pressure frac tubing extending between a frac pump and a wellhead;

a sensor operably disposed to detect pressure in the high pressure frac tubing;

a user interface configured to receive operator inputs representing a desired pressure threshold from an operator;

a controller configured to receive the desired pressure threshold entered at the user interface, configured to receive data from the sensor representing a detected pressure, and configured to compare the detected pressure to the desired pressure threshold;

a valve actuation system in communication with the pressure relief valve and in communication with the controller, the valve actuation system being configured to change the state of the pressure relief valve from a closed state to an open state in response to a command signal from the controller;

an actuation fluid source in communication with the valve actuation system, the actuation fluid source providing fluid pressurized to maintain the state of the pressure relief valve in a closed state; and a regulator structure carrying the valve actuation system and the actuation fluid source in a single transportable unit.

38. The pressure relief valve system of claim 37, wherein the regulator structure is a skid.

39. The pressure relief valve system of claim 37, wherein the regulator structure comprises:

a hose reel carrying a hose extendable between the valve actuation system and the pressure relief valve and configured to place the valve actuation system and the pressure relief valve in fluid communication; and a data cable reel carrying a data cable extendable between the valve actuation system and the controller and configured to place the valve actuation system and the controller in electrical communication.

40. The pressure relief valve system of claim 37, wherein the regulator structure carries the controller and comprises:

a hose reel carrying a hose extendable between the valve actuation system and the pressure relief valve and configured to place the valve actuation system and the pressure relief valve in fluid communication; and a data cable reel carrying a data cable extendable between the controller and the user interface and configured to place the controller and the user interface in electrical communication.

41. A pressure relief valve system for high pressure frac tubing, the pressure relief valve system comprising:

a pressure relief valve;

a sensor configured to detect pressure;

a controller configured to receive data from the sensor representing a detected pressure, and configured to compare the detected pressure to a pressure threshold;

a valve actuation system configured to be in communication with each of the pressure relief valve and the controller, the valve actuation system being configured to change the state of the pressure relief valve from a closed state to an open state in response to a command signal from the controller; and an actuation fluid source configured to be in fluid communication with the valve actuation system and configured to supply pressurized fluid to the valve actuation system at a first fluid pressure;

wherein the valve actuation system is configured to reduce the pressure of the pressurized fluid from the first fluid pressure to a second fluid pressure that is less than the first fluid pressure; and wherein the second fluid pressure of the pressurized fluid is suitable to maintain the pressure relief valve in the closed state.

42. The pressure relief valve system of claim 41, wherein the actuation fluid source is a gas source;

wherein the pressurized fluid is a pressurized gas; and wherein the first and second fluid pressures are first and second gas pressures, respectively, of the pressurized gas.

43. The pressure relief valve system of claim 42, wherein the gas source comprises a nitrogen tank.

44. The pressure relief valve system of claim 41, wherein, when the pressure relief valve is in the closed state, the second fluid pressure is about 105-150% of another fluid pressure that opens the pressure relief valve.

45. The pressure relief valve system of claim 41, wherein the valve actuation system comprises:

an input portion configured to be connected to the actuation fluid source;

an output portion configured to be connected to the pressure relief valve; and a reducing valve configured to be in fluid communication with each of the input and output portions, and configured to adjust the pressure in the output portion based on data from the controller.

46. The pressure relief valve system of claim 45, wherein the actuation fluid source is a gas source;

wherein the pressurized fluid is a pressurized gas;

wherein the first and second fluid pressures are first and second gas pressures, respectively, of the pressurized gas;

wherein the output portion is configured to contain the pressurized gas at the second gas pressure;

wherein the reducing valve is configured to adjust the second gas pressure based on the data from the controller; and wherein the input portion is configured to contain the pressurized gas at a third gas pressure.

47. The pressure relief valve system of claim 46, wherein the third gas pressure is equal to the first gas pressure.

48. The pressure relief valve system of claim 46, further comprising: a first pressure transmitter configured to detect the third gas pressure of the pressurized gas; and a second pressure transmitter configured to detect the second gas pressure of the pressurized gas.

49. The pressure relief valve system of claim 41, further comprising a regulator structure carrying the valve actuation system and the actuation fluid source in a single transportable unit.

50. The pressure relief valve system of claim 49, wherein the regulator structure comprises:

a hose reel carrying a hose extendable between the valve actuation system and the pressure relief valve and configured to place the valve actuation system and the pressure relief valve in fluid communication; and a data cable reel carrying a data cable extendable between the valve actuation system and the controller and configured to place the valve actuation system and the controller in electrical communication.

51. The pressure relief valve system of claim 41, wherein the controller is configured to emit the command signal when:

the pressure threshold is stored in the controller; and the controller determines that the detected pressure exceeds the pressure threshold.

52. The pressure relief valve system of claim 41, wherein the valve actuation system comprises a dump valve configured to receive the command signal from the controller.

53. The pressure relief valve system of claim 41, wherein the controller is configured to receive an operator input that sets the pressure threshold, the controller also being configured to receive an operator input that sets a reset pressure for the pressure relief valve.

54. The pressure relief valve system of claim 41, wherein the controller is configured to average the detected pressure over an increment of time and compare the average detected pressure to the pressure threshold.

* * * * *